US009233565B2

(12) United States Patent
Watanabe

(10) Patent No.: US 9,233,565 B2
(45) Date of Patent: Jan. 12, 2016

(54) APPARATUS AND NON-TRANSITORY COMPUTER-READABLE MEDIUM

(71) Applicant: BROTHER KOGYO KABUSHIKI KAISHA, Nagoya-shi, Aichi (JP)

(72) Inventor: Takeshi Watanabe, Nagoya (JP)

(73) Assignee: BROTHER KOGYO KABUSHIKI KAISHA, Nagoya-Shi (JP)

( * ) Notice: Subject to any disclaimer, the term of this patent is extended or adjusted under 35 U.S.C. 154(b) by 0 days.

(21) Appl. No.: 14/582,831

(22) Filed: Dec. 24, 2014

(65) Prior Publication Data

US 2015/0109361 A1 Apr. 23, 2015

Related U.S. Application Data

(62) Division of application No. 13/746,851, filed on Jan. 22, 2013, now abandoned.

(30) Foreign Application Priority Data

Jan. 27, 2012 (JP) ..... 2012-015846
Jan. 27, 2012 (JP) ..... 2012-015849
Jan. 9, 2013 (JP) ..... 2013-001479

(51) Int. Cl.
*B41J 29/38* (2006.01)
*B41J 25/00* (2006.01)
(Continued)

(52) U.S. Cl.
CPC *B41J 25/006* (2013.01); *B41J 2/07* (2013.01); *B41J 2/2117* (2013.01); *B41J 2/2132* (2013.01)

(58) Field of Classification Search
CPC ..... B41J 2/2114; B41J 2/2117; B41J 11/002; B41J 19/142; B41J 19/147
USPC ..... 347/5, 9, 10, 12, 13, 15, 41, 43, 98, 100
See application file for complete search history.

(56) References Cited

U.S. PATENT DOCUMENTS 6,145,978 A 11/2000 Kato et al.
6,164,756 A 12/2000 Takahashi et al.
6,227,649 B1 5/2001 Hirabayashi et al.
(Continued)

FOREIGN PATENT DOCUMENTS

JP H07-205541 A 8/1995
JP H10-166559 A 6/1998
(Continued)

OTHER PUBLICATIONS

Office Action issued in the corresponding Japanese patent application No. 2012-015849 mailed Sep. 29, 2015.

*Primary Examiner* — Hai C Pham
(74) *Attorney, Agent, or Firm* — Fox Rothschild LLP

(57) ABSTRACT

An apparatus includes a memory storing computer-readable instructions to cause the apparatus to perform determining a scanning number of times. The scanning number of times is a number of times that a carriage of a printer is to be moved to increase a maximum density of a first ink to be higher than a unit density. The instructions also cause the apparatus to perform generating print data to cause ejection of the first and a second ink by multi-pass scans in a final printing unit. The final printing unit is continuous scans corresponding to a number of passes including a last scan, among the scans to be performed the scanning number of times. The second ink is an ink whose density is equal to or less than the unit density, among the different inks.

20 Claims, 19 Drawing Sheets

(51) Int. Cl.
*B41J 2/07* (2006.01)
*B41J 2/21* (2006.01)

(56) References Cited

U.S. PATENT DOCUMENTS

| | | | | |
|---|---|---|---|---|
| 6,582,047 | B2 | 6/2003 | Koitabashi et al. | |
| 6,902,249 | B2 | 6/2005 | Suzuki et al. | |
| 7,794,077 | B2 * | 9/2010 | Falser et al. | 347/104 |
| 8,125,688 | B2 | 2/2012 | Watanabe | |
| 2005/0117009 | A1 | 6/2005 | Kawaguchi et al. | |
| 2005/0237352 | A1 | 10/2005 | Yoneyama | |
| 2009/0237684 | A1 | 9/2009 | Watanabe | |
| 2009/0244568 | A1 | 10/2009 | Watanabe | |
| 2009/0256871 | A1 | 10/2009 | Toyama et al. | |

FOREIGN PATENT DOCUMENTS

| | | | |
|---|---|---|---|
| JP | 2003-175587 | A | 6/2003 |
| JP | 2005-144749 | A | 6/2005 |
| JP | 2005-161583 | A | 6/2005 |
| JP | 2009-231992 | A | 10/2009 |
| JP | 2009-241419 | A | 10/2009 |

* cited by examiner

FIG. 8

21

| COLOR MODE CONVERSION TABLE | | | | | | | |
|---|---|---|---|---|---|---|---|
| sRGB VALUES | | | CMYKW VALUES | | | | |
| R | G | B | C | M | Y | K | W |
| 0 | 0 | 0 | 0 | 0 | 0 | 0 | 0 |
| 64 | 0 | 0 | 0 | 32 | 45 | 0 | 30 |
| 128 | 0 | 0 | 0 | 101 | 123 | 0 | 100 |
| 192 | 0 | 0 | 0 | 190 | 210 | 0 | 150 |
| 255 | 0 | 0 | 0 | 255 | 250 | 0 | 255 |
| 0 | 64 | 0 | 50 | 23 | 10 | 10 | 32 |
| 64 | 64 | 0 | 100 | 32 | 45 | 35 | 120 |
| 128 | 64 | 0 | 80 | 62 | 70 | 55 | 145 |
| 192 | 64 | 0 | 20 | 102 | 190 | 15 | 180 |
| 255 | 64 | 0 | 0 | 180 | 250 | 0 | 255 |
| ・・・ | ・・・ | ・・・ | ・・・ | ・・・ | ・・・ | ・・・ | ・・・ |
| 0 | 192 | 255 | 255 | 20 | 0 | 0 | 250 |
| 64 | 192 | 255 | 190 | 21 | 0 | 0 | 251 |
| 128 | 192 | 255 | 128 | 31 | 0 | 0 | 253 |
| 192 | 192 | 255 | 54 | 25 | 0 | 0 | 254 |
| 255 | 192 | 255 | 0 | 20 | 0 | 0 | 255 |
| 0 | 255 | 255 | 255 | 10 | 0 | 0 | 255 |
| 64 | 255 | 255 | 198 | 2 | 0 | 0 | 251 |
| 128 | 255 | 255 | 130 | 0 | 0 | 0 | 245 |
| 192 | 255 | 255 | 55 | 0 | 0 | 0 | 250 |
| 255 | 255 | 255 | 0 | 0 | 0 | 0 | 255 |

APPARATUS AND NON-TRANSITORY COMPUTER-READABLE MEDIUM

CROSS-REFERENCE TO RELATED APPLICATION

This application is a Divisional application of U.S. Ser. No. 13/746,851, filed on Jan. 22, 2013, which claims priority to Japanese Patent Application Nos. 2012-15846 and 2012-15849 filed on Jan. 27, 2012, and also claims priority to Japanese Patent Application No. 2013-1479 filed on Jan. 9, 2013. The disclosures of the foregoing applications are herein incorporated by reference in their entirety.

BACKGROUND

The present disclosure relates to a printer and a printing method that can eject an amount of ink that is larger than an amount of the ink that can be ejected during one scan of a carriage, to each of dot arrays that extend in a main scanning direction. The present disclosure also relates to an apparatus that can generate print data.

In related art, a technique is known that causes a printer to eject ink while moving a carriage a plurality of times in order to form a dot array. For example, after performing printing using a white ink, an image forming device may perform heat fixing of the printed white ink. The image forming device may repeatedly perform printing and heat fixing of the white ink a plurality of times. In this manner, the image forming device can achieve good color development by ejecting a large amount of the white ink onto a print medium. A printing method in which printing with an ink of the same color is performed by moving a carriage a plurality of times for each of the dot arrays will be hereinafter referred to as overprinting.

SUMMARY

When a known print data generation device causes a printer to perform overprinting, the device generates print data for each scan. Therefore, as compared to a case in which overprinting is not performed, a processing load on the print data generation device may increase and the amount of the print data may also increase. As a result, in the related art, there may be cases in which processing cannot be performed efficiently when overprinting is performed.

Embodiments provide an apparatus that includes a control portion and a memory configured to store computer-readable instructions. When executed by the control portion, the computer-readable instructions cause the apparatus to perform a step of determining a scanning number of times. The scanning number of times is a number of times that a carriage of a printer is to be moved in a main scanning direction to increase a maximum density of a first ink to be higher than a unit density. The carriage is mounted with a plurality of ink heads that are respectively configured to eject different inks including the first ink. The unit density is a density of a maximum amount of ink that can be ejected by moving the carriage once with respect to a dot array extending in the main scanning direction.

The computer-readable instructions also cause the apparatus to perform a step of generating, in a case where the scanning number of times is larger than a minimum value of a number of passes that can be set, print data to cause ejection of the first ink and ejection of a second ink to be performed by multi-pass scans in a final printing unit, among a plurality of scans to be performed the scanning number of times.

The multi-pass scans is a plurality of scans in which, every time a scan is performed, an ink is ejected to the dot array from a nozzle different from a nozzle used in a preceding scan, among a plurality of nozzles provided on each of the plurality of ink heads. The number of passes is a number of scans included the multi-pass scans. The final printing unit is continuous scans corresponding to the number of passes including a last scan, among the scans to be performed the scanning number of times. The second ink is an ink whose density is equal to or less than the unit density, among the different inks.

Embodiments also provide a non-transitory computer-readable medium storing computer-readable instructions. When executed by a processor of a computer, the computer-readable instructions cause the computer to perform a determination operation determining a scanning number of times. The scanning number of times is a number of times that a carriage of a printer is to be moved in a main scanning direction to increase a maximum density of a first ink to be higher than a unit density. The carriage is mounted with a plurality of ink heads that are respectively configured to eject different inks including the first ink. The unit density is a density of a maximum amount of ink that can be ejected by moving the carriage once with respect to a dot array extending in the main scanning direction.

The computer-readable instructions also cause the computer to perform a generation operation, in a case where the scanning number of times is larger than a minimum value of a number of passes that can be set, print data to cause ejection of the first ink and ejection of a second ink to be performed by multi-pass scans in a final printing unit, among a plurality of scans to be performed the scanning number of times. The multi-pass scans is a plurality of scans in which, every time a scan is performed, an ink is ejected to the dot array from a nozzle different from a nozzle used in a preceding scan, among a plurality of nozzles provided on each of the plurality of ink heads. The number of passes is a number of scans included the multi-pass scans. The final printing unit is continuous scans corresponding to the number of passes including a last scan, among the scans to be performed the scanning number of times. The second ink is an ink whose density is equal to or less than the unit density, among the different inks.

BRIEF DESCRIPTION OF THE DRAWINGS

Embodiments will be described below in detail with reference to the accompanying drawings in which:

FIG. 8 is a data structure diagram of a color mode conversion table;

DETAILED DESCRIPTION

Hereinafter, an embodiment will be explained with reference to the drawings. A printing system 100 that includes a personal computer (hereinafter simply referred to as PC) 1 and a printer 30 will be explained with reference to FIG. 1. The printer 30 is a known inkjet printer for fabrics. The printer 30 is configured to eject ink while moving ink heads 35 (refer to FIG. 2), and thereby performing printing on a fabric, which is a print medium. The PC 1 can generate print data to cause the printer 30 to perform printing.

Figure 1:
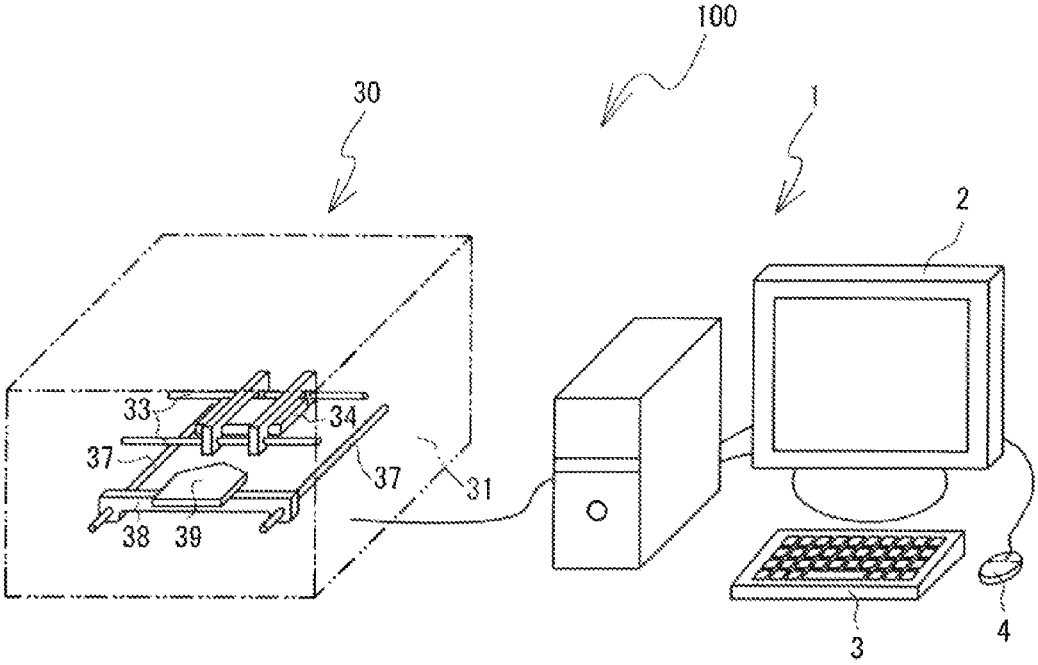
FIG. 1 is a perspective view showing an outline of a printing system.

An outline of the printer 30 will be explained with reference to FIG. 1 and FIG. 2. The lower left side and the upper right side of FIG. 1 respectively correspond to the front side and the back side of the printer 30. The left-right direction and the up-down direction of FIG. 1 respectively correspond to the left-right direction and the up-down direction of the printer 30. As shown in FIG. 1, the printer 30 includes a housing 31 having a rectangular box shape. A pair of guide rails 33 extend in the left-right direction, substantially in the center of the housing 31 in the front-rear direction. A carriage 34 is supported by the guide rails 33 such that the carriage 34 can move in the left-right direction (a main scanning direction) along the guide rails 33. Hereinafter, a movement of the ink heads 35 or the carriage 34 in the main scanning direction is also referred to a scan. Although not shown in detail in the drawings, the carriage 34 is configured such that the carriage 34 can be moved in the main scanning direction by a main scanning mechanism. The main scanning mechanism includes a main scanning motor 46 (refer to FIG. 6) and a belt. The plurality of ink heads 35 (refer to FIG. 2) are provided on a lower portion of the carriage 34. An arrangement of the ink heads 35 will be described later with reference to FIG. 2.

A pair of guide rails 37 that extend in the front-rear direction are provided inside the housing 31, in a substantially central lower portion of the housing 31 in the left-right direction. A platen support 38 is supported by the guide rails 37 such that the platen support 38 can move in the front-rear direction (a sub-scanning direction) along the guide rails 37. Although not shown in detail in the drawings, the platen support 38 is configured such that the platen support 38 can be moved in the sub-scanning direction by a sub-scanning mechanism. The sub-scanning mechanism includes a sub-scanning motor 47 (refer to FIG. 6) and a belt. A replaceable platen 39 is fixed to substantially the center, in the left-right direction, of a top surface of the platen support 38. The platen 39 is a plate member having a substantially pentagonal shape in a plan view. A fabric, such as a t-shirt, may be placed on a top surface of the platen 39.

The printer 30 can form dot arrays extending in the main scanning direction by ejecting ink while moving the ink heads 35 in the main scanning direction. When one or more scans in the main scanning direction are complete, the printer 30 moves the platen 39 in the sub-scanning direction. After that, the printer 30 forms dot arrays extending in the main scanning direction again, in the same manner as described above. The printer 30 performs printing by repeatedly performing the above-described operations in accordance with the print data and forming a plurality of dot arrays on the print medium.

The printer 30 of the present embodiment is configured to move the carriage 34 in the main scanning direction and to move the platen 39 in the sub-scanning direction. Thus, the printer 30 can relatively move the carriage 34 and the print medium held by the platen 39. The sub-scanning direction (the front-rear direction of the printer 30, in the present embodiment) is a direction orthogonal to the main scanning direction (the left-right direction of the printer 30, in the present embodiment). A method for relatively moving the carriage 34 and the print medium is not limited to the method of the present embodiment. For example, the platen 39 may be moved in the main scanning direction and the carriage 34 may be moved in the sub-scanning direction. Alternatively, just the platen 39 may be moved in the main scanning direction and the sub-scanning direction, or just the carriage 34 may be moved in the main scanning direction and the sub-scanning direction. When just the platen 39 is moved, the carriage 34 only holds the ink heads 35 and does not move. The print medium may be moved using a roller or the like instead of the platen 39.

The structure of the carriage 34 will be explained. As shown in FIG. 2, the plurality of ink heads 35 are mounted on the carriage 34 of the present embodiment. A plurality of fine nozzles 36 are provided in a bottom portion of each of the ink heads 35. Each of the nozzles 36 has an ejection port that opens in the bottom surface of each of the ink heads 35. In the present embodiment, the number of the nozzles 36 that are actually provided on each of the ink heads 35 is 128. However, the number of the nozzles 36 in FIG. 2 has been reduced in order to simplify the drawing. The ink supplied from ink cartridges (not shown in the drawings) to the ink heads 35 may be ejected downward from the ejection ports of the nozzles 36 by driving of piezoelectric elements. The plurality of nozzles 36 on each of the ink heads 35 are arranged side by side in a direction (the sub-scanning direction in the present embodiment) that intersects with the main scanning direction.

The printer 30 of the present embodiment can perform printing by ejecting both a white ink and a color ink (i.e. an ink whose color is different from white) to the print medium while the carriage 34 is moved in the main scanning direction. More specifically, the printer 30 of the present embodiment can perform simultaneous printing of white and color by using the carriage 34 shown in FIG. 2. Therefore, the printer 30 can complete printing in a relatively short time. Both white ink heads 35W and color ink heads 35C, 35M, 35Y and 35K are mounted on the carriage 34. Hereinafter, the color ink heads 35C, 35M, 35Y and 35K are also collectively referred to as color ink heads 35CL.

The white ink heads 35W are each configured to eject the white ink. The color ink head 35C is configured to eject a cyan ink. The color ink head 35M is configured to eject a magenta ink. The color ink head 35Y is configured to eject a yellow ink. The color ink head 35K is configured to eject a black ink.

That is, the ejection ports of the 128 nozzles 36 that are provided on each of the ink heads 35 form an ejection port array that is configured to eject an ink of the same color. In the example shown in FIG. 2, the four white ink heads 35W are arranged side by side in the main scanning direction. Further, the four color ink heads 35C, 35M, 35Y and 35K are arranged side by side in the main scanning direction, in positions displaced from the four white ink heads 35W in the sub-scanning direction.

In the present embodiment, a plurality of ejection ports that are configured to eject an ink of the same color is defined as an ejection port group. The four ejections port arrays of the white ink heads 35W arranged side by side in the main scanning direction form an ejection port group for the white ink. The ejection port army of the color ink head 35C forms an ejection port group for the cyan ink. The ejection port array of the color ink head 35M forms an ejection port group for the magenta ink. The ejection port array of the color ink head 35Y forms an ejection port group for the yellow ink. The ejection port array of the color ink head 35K forms an ejection port group for the black ink.

When print processing is performed by the printer 30, the color inks are ejected onto the white ink. During printing, the platen 39 (refer to FIG. 1) moves to the lower side in FIG. 2 with respect to the carriage 34. That is, the feed direction of the platen 39 is a direction heading from the upper side toward the lower side in FIG. 2 along the sub-scanning direction. The white ink heads 35W are arranged on an upstream side of the color ink heads 35CL in the feed direction of the platen 39. Note that the white ink heads 35W and the color ink heads 35C, 35M, 35Y and 35K may be in contact with or separated from each other.

In the present embodiment, one ejection port array that can eject an ink of the same color is provided on each one of the ink heads 35. The ejection port group for the white ink is provided on a plurality of ink heads 35 and each of the ejection port groups for cyan, magenta, yellow and black is provided on one ink head 35. However, the correspondence relationship between the ink heads 35 and the ejection port arrays as well as the correspondence relationship between the ink heads 35 and the ejection port groups are not limited to this example. For example, a plurality of ejection port arrays that can respectively eject different color inks may be provided on one ink head 35. For example, in the example shown in FIG. 2, one of the white ink heads 35W located on the upstream side in the feed direction of the platen 39 and one of the color ink heads 35CL located on the downstream side may be integrated into one ink head. Specifically, the nozzles 36 of the white ink head 35W that is located at the left end and the nozzles 36 of the color ink head 35C that is located at the left end may be provided on a single ink head. In a similar manner, the white ink head 35W and the color ink head 35M that are second from the left may be integrated into one ink head, the white ink head 35W and the color ink head 35Y that are second from the right may be integrated into one ink head, and the white ink head 35W and the color ink head 35K that are located at the right end may be integrated into one ink head. In this case, one ink head includes an ejection port array of a white ink on the upstream side in the feed direction of the platen 39, and includes an ejection port array (en ejection port group) of a color ink on the downstream side.

Figure 2:
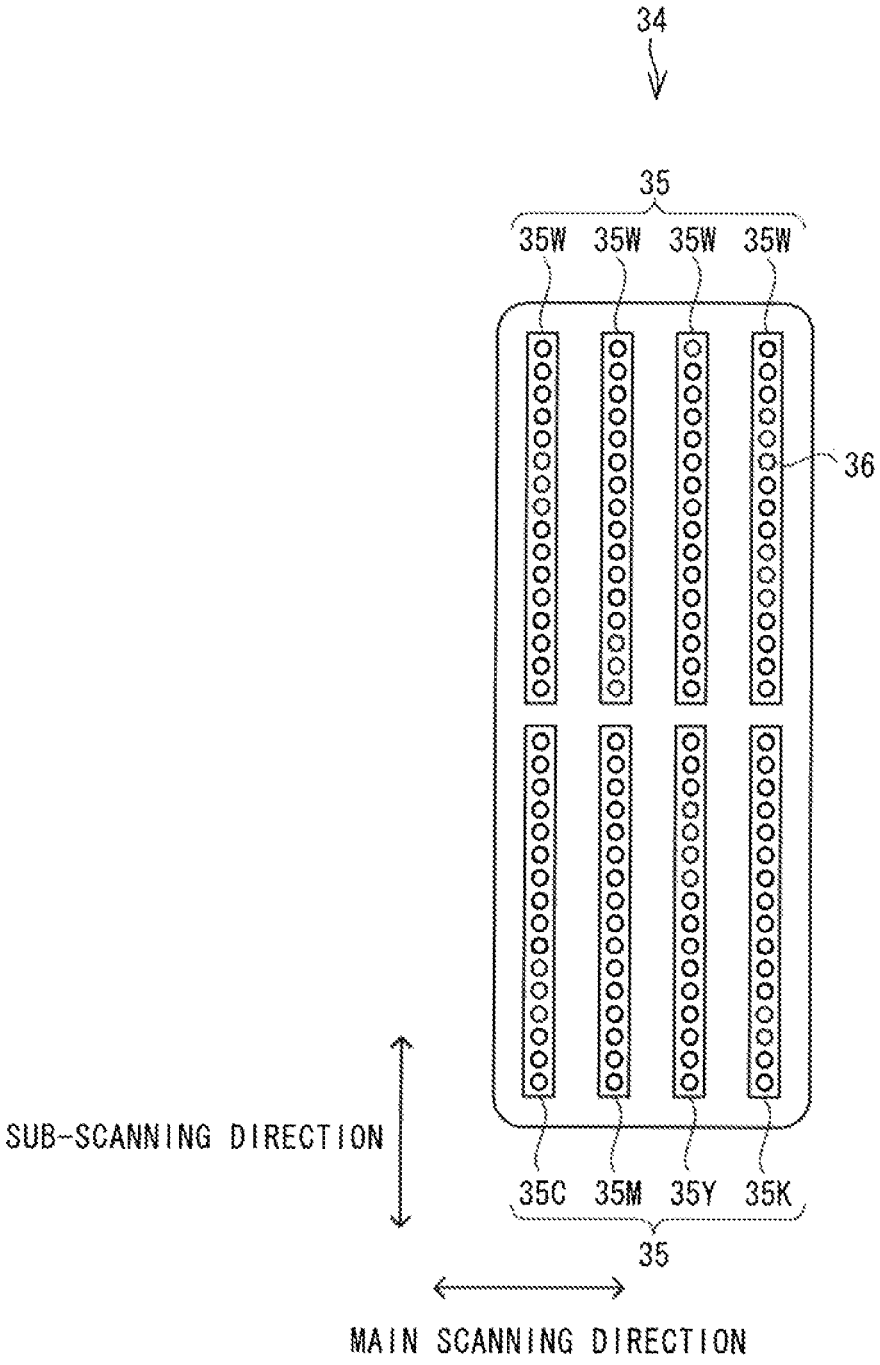
FIG. 2 is a bottom plan view of a carriage.

Alternatively, in the example shown in FIG. 2, at least two of the color ink heads 35C, 35M, 35Y and 35K may be integrated into one ink head. For example, the color ink heads 35C and 35M may be integrated into one ink head, and the color ink heads 35Y and 35K may be integrated into one ink head. In this case, one ink head has a structure in which an ejection port group of a certain color ink and an ejection port group of a different color ink are arranged side by side in the main scanning direction. Further, the ejection port group for the white ink including the four ejection port arrays may be mounted on one ink head or on a plurality of ink heads.

The specific configuration of the carriage 34 may also be changed. For example, just the three color ink heads 35C, 35M and 35Y may be used, without using the color ink head 35K that ejects the black ink. In this case, the black color may be expressed by mixing the three colors of cyan, magenta and yellow. The color ink heads may include an ink head that ejects an ink whose color is not cyan, magenta, yellow or black (an ink head that ejects an ink whose color is gold, silver or the like, for example). The number of the white ink heads 35W is not limited to four. The number of the nozzles 36 that are provided on each of the ink heads 35 may be changed.

In the printer 30, the carriage 34 is configured such that the four white ink heads 35W can be mounted on and removed from the carriage 34. Therefore, a user can change the number of the white ink heads 35W mounted on the carriage 34 to a number from one to four. More specifically, even after a model is purchased in which the two white ink heads 35W are mounted on the carriage 34, the user can change the model of the printer 30 by additionally mounting two more white ink heads 35W on the carriage 34. Although details will be described later, the PC 1 according to the present embodiment can generate print data that causes any of a variety of models having a different number of the white ink heads 35W to perform printing. The user can also specify only one or some of the plurality of white ink heads 35W mounted on the carriage 34 to be used for printing.

A printing method that can be performed by the printer 30 in accordance with the print data generated by the PC 1 will be explained. The PC 1 can generate the print data that can cause the printer 30 to eject an amount of ink that is larger than an amount that can be ejected during one scan of the carriage 34, to each of the dot arrays extending in the main scanning direction. With a particular ink, such as a white ink, there may be cases in which good color development cannot be achieved with only one scan of the carriage 34. The printer 30 can perform an operation (so-called overlay ejecting) that forms each of the dot arrays through a process of performing scans of the carriage 34 a plurality of times. Therefore, the printer 30 can reproduce good color development by ejecting a large amount of ink onto the print medium. Hereinafter, a printing method in which overlay ejecting of an ink of the same color is performed will be referred to as overprinting.

The PC 1 can also generate the print data that causes the printer 30 to perform printing using a multi-pass method, which is one type of overprinting. The multi-pass method is a method in which a plurality of scans of the carriage 34 is performed with respect to each of the dot arrays and printing is performed using a different one of the nozzles 36 every time a scan is performed with respect to the same dot array. The ink ejection direction and the ink ejection amount may vary for each of the nozzles 36. Further, movement amounts of the ink heads 35 in the sub-scanning direction may vary. Therefore, if one dot array is completed by one scan (a pass) in the main scanning direction, a stripe may appear (banding may occur) between the dot arrays and thus printing quality may deteriorate. If the amount of ink of each of the dot arrays is different from each other, this may also cause deterioration of printing quality. By performing printing using the multi-pass method (hereinafter also referred to as multi-pass printing), the printer 30 can reduce the influence of various variations derived from the printer 30 itself and to improve printing quality.

In the present embodiment, a first method, a second method and a third method are adopted as specific methods for the printer 30 to perform the above-described overprinting. In the first method, the multi-pass method is used. In the second method, printing of a whole version is repeatedly performed a plurality of times. In the third method, after the carriage 34 is repeatedly moved in the main scanning direction a plurality of times, the platen 39 is moved in the sub-scanning direction. Hereinafter, each of the first to third methods will be explained in detail with reference to FIG. 3 to FIG. 5.

The first method will be explained. Generally, when print data of the multi-pass method is generated, thinning processing is performed. The thinning processing is processing that controls the ejection amount of ink by thinning out the ink ejection in each of a plurality of scans in accordance with a predetermined algorithm, with respect to the dots that are set as targets of ink ejection. A percentage at which the ink ejection is thinned out in each scan is called a thinning rate. When the thinning processing is performed, a usage rate (%) of the ejection ports in each scan is a value obtained by subtracting the thinning rate (%) from 100%. If the total sum of the usage rates of the ejection ports in the plurality of scans exceeds 100%, an amount of ink can be ejected that is larger than the amount of the ink that can be ejected in a single scan. In other words, with the multi-pass method, it is also possible to increase the amount of ink to be ejected while improving printing quality. Note, however, that if the thinning processing is performed for each scan, a processing load on the PC 1 increases. The PC 1 of the present embodiment can generate the print data of the multi-pass method without increasing the processing load. The specific processing content will be described later.

Figure 3:
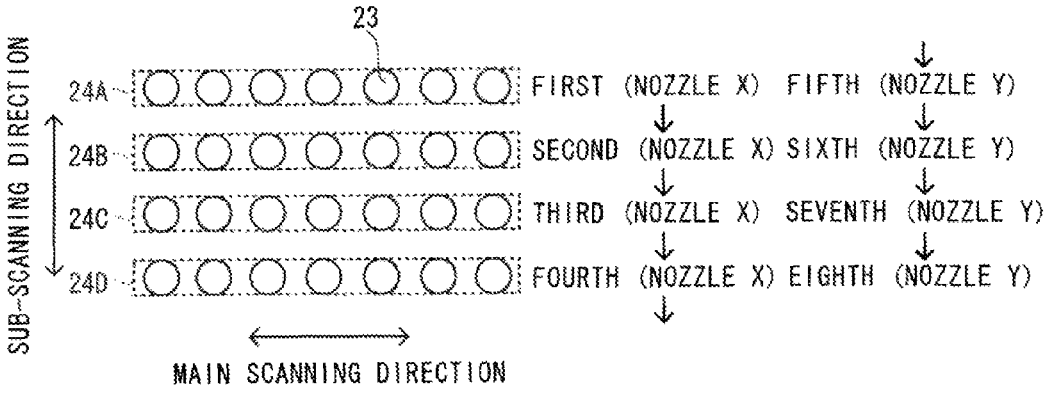
FIG. 3 is an explanatory diagram illustrating a first method of overprinting.

FIG. 3 shows a case in which printing is performed using the first method with respect to four dot arrays 24A, 24B, 24C and 24D each including a plurality of dots 23. First, the printer 30 moves the carriage 34 (refer to FIG. 2) once in the main scanning direction, and ejects the ink to the dot array 24A from a particular nozzle X of the plurality of nozzles 36. Then, the printer 30 moves the print medium to the downstream side (in the upward direction in FIG. 3) in the feed direction along the sub-scanning direction, with respect to the carriage 34. The printer 30 then ejects the ink from the nozzle X to the dot array 24B. The printer 30 performs printing while moving the nozzle X in the main scanning direction once for each of the four dot arrays 24A to 24D by repeating the above-described operation. Then, the printer 30 moves the print medium further to the downstream side (in the upward direction in FIG. 3) in the feed direction and ejects the ink to the dot array 24A from a nozzle Y that is different from the nozzle X. In a similar manner, by moving the nozzle Y with respect to each of the four dot arrays 24B to 24D as well, the printer 30 completes the printing. As described above, in the first method, a different one of the nozzles 36 is moved with respect to each of the four dot arrays 24A to 24D every time a scan is performed. As a result, the influence of various variations can be reduced.

Figure 4:
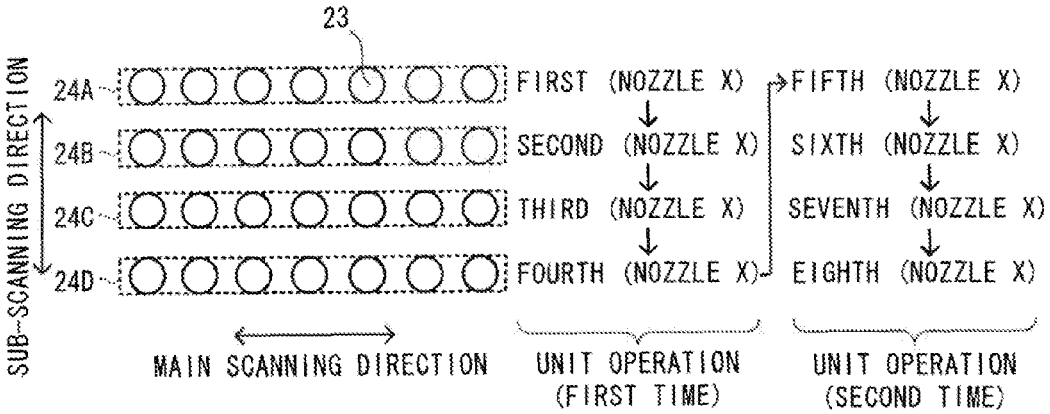
FIG. 4 is an explanatory diagram illustrating a second method of overprinting.
Figure 5:
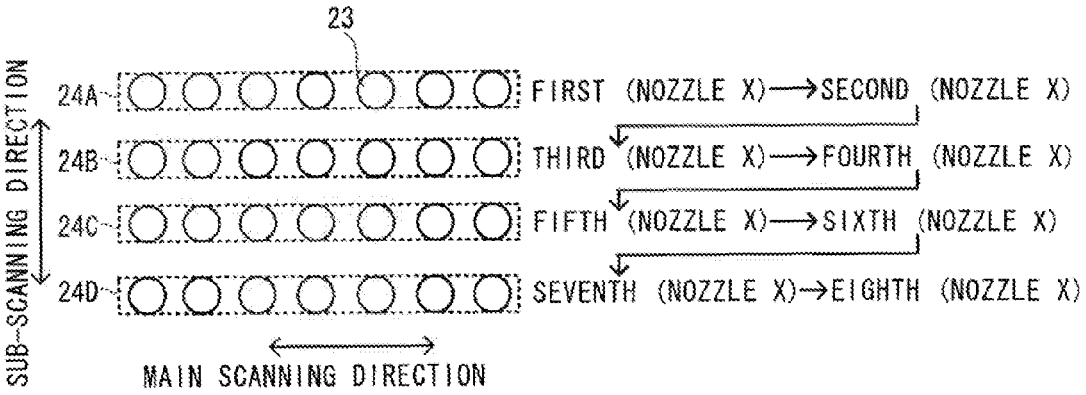
FIG. 5 is an explanatory diagram illustrating a third method of overprinting.

The second method will be explained. In the second method, the printing operation is repeated in accordance with one set of print data. A unit operation is defined as an operation that performs printing on an entire printing area while moving one of the nozzles 36 (the nozzle X in FIG. 4) with respect to each of the dot arrays 24A to 24D as shown in FIG. 4. In a case where the printer 30 is operated using the second method, one set of print data is generated to control the unit operation. When the printer 30 ends the unit operation in accordance with the set of print data, the printer 30 returns the position of the print medium with respect to the carriage 34 to a printing start position and repeats the unit operation. More specifically, overlay ejecting is performed with respect to each of the dot arrays 24A to 24D using the same nozzle X. In the second method in which printing of the whole version is repeated, it is possible to inhibit an increase in the amount of print data. Further, after the ink ejected by the single unit operation has dried to a certain extent, the ink is ejected by the next unit operation. Thus, ink bleeding is less likely to occur and it is possible to generate an accurate image.

The third method will be explained. In the third method, the printer 30 performs overlay ejecting of the same ink by moving one of the nozzles 36 in the main scanning direction a plurality of times for one dot array. After that, the printer 30 causes the position of the carriage 34 with respect to the print medium to move in the sub-scanning direction. More specifically, after performing overlay ejecting with respect to one dot array, the printer 30 ejects the ink to the next dot array. In the example shown in FIG. 5, first, the printer 30 moves the nozzle X in the main scanning direction with respect to the dot array 24A and ejects the ink. Next, the printer 30 moves the carriage 34 in a reverse direction along the main scanning direction without moving the print medium in the sub-scanning direction, and moves the nozzle X with respect to the dot array 24A again. After that, the printer 30 moves the print medium in the sub-scanning direction and performs overlay ejecting with respect to the dot array 24B. Also in the third method, it is possible to inhibit an increase in the amount of print data. Further, the ink to be overlaid is ejected before the previously ejected ink has dried. Therefore, the ink is more likely to bleed and spread in comparison with the second method. As a result, gaps in which no ink is applied can be reduced and the color of the ink can be expressed accurately.

Figure 6:
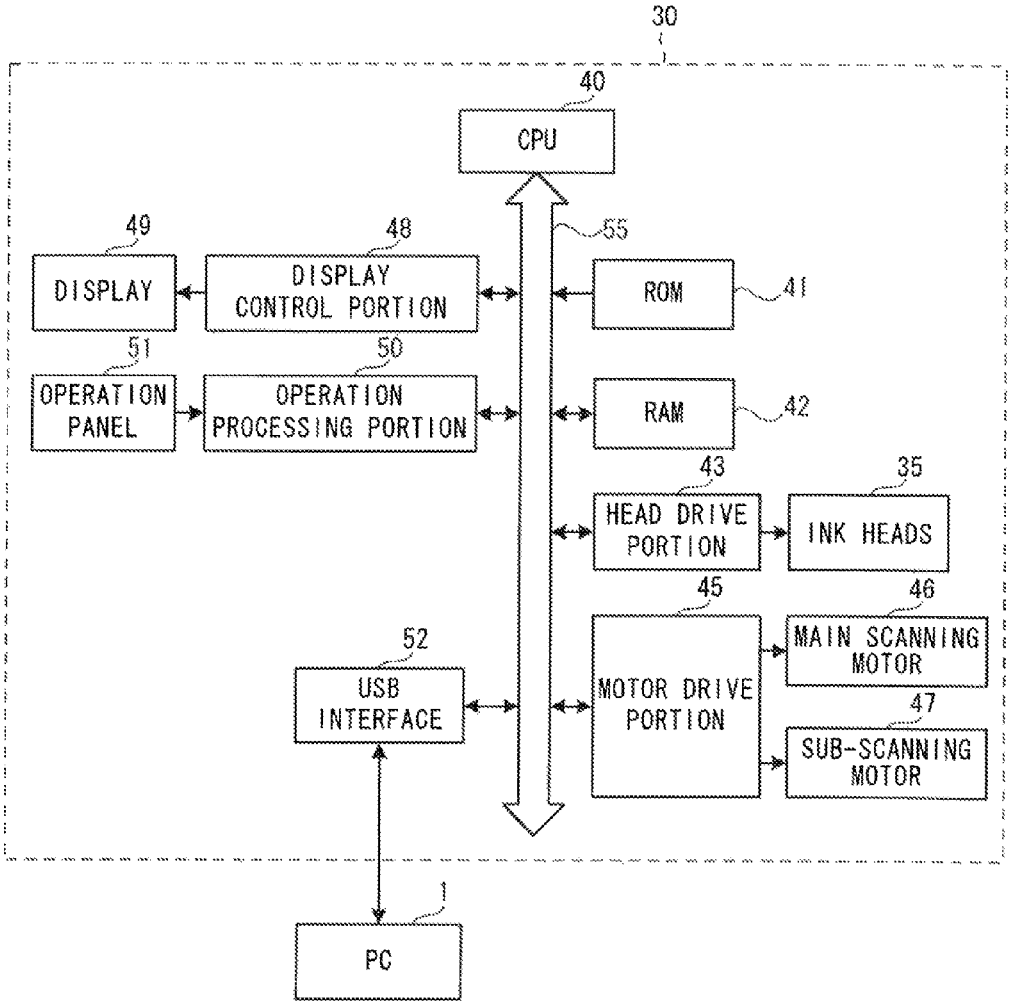
FIG. 6 is a block diagram showing an electrical configuration of a printer.

An electrical configuration of the printer 30 will be explained with reference to FIG. 6. The printer 30 includes a CPU 40 that performs overall control of the printer 30. A ROM 41, a RAM 42, a head drive portion 43, a motor drive portion 45, a display control portion 48, an operation processing portion 50 and a USB interface 52 are each connected to the CPU 40 via a bus 55.

A control program to control operations of the printer 30 and initial values etc. may be stored in the ROM 41. The RAM 42 may temporarily store various types of data, such as print data received from the PC 1. The head drive portion 43 is connected to the ink heads 35 that eject ink. The head drive portion 43 is configured to drive a piezoelectric element that is provided on each of ejection channels of the ink heads 35. The motor drive portion 45 is configured to drive the main scanning motor 46 and the sub-scanning motor 47. The main scanning motor 46 may cause the ink heads 35 to move in the main scanning direction via the main scanning mechanism. The sub-scanning motor 47 may cause the platen 39 to move in the sub-scanning direction via the sub-scanning mechanism. The display control portion 48 is configured to control display of a display 49 in accordance with a command from the CPU 40. The operation processing portion 50 is configured to detect an operation input performed on an operation panel 51. The USB interface 52 is configured to connect the printer 30 to an external device, such as the PC 1.

Figure 7:
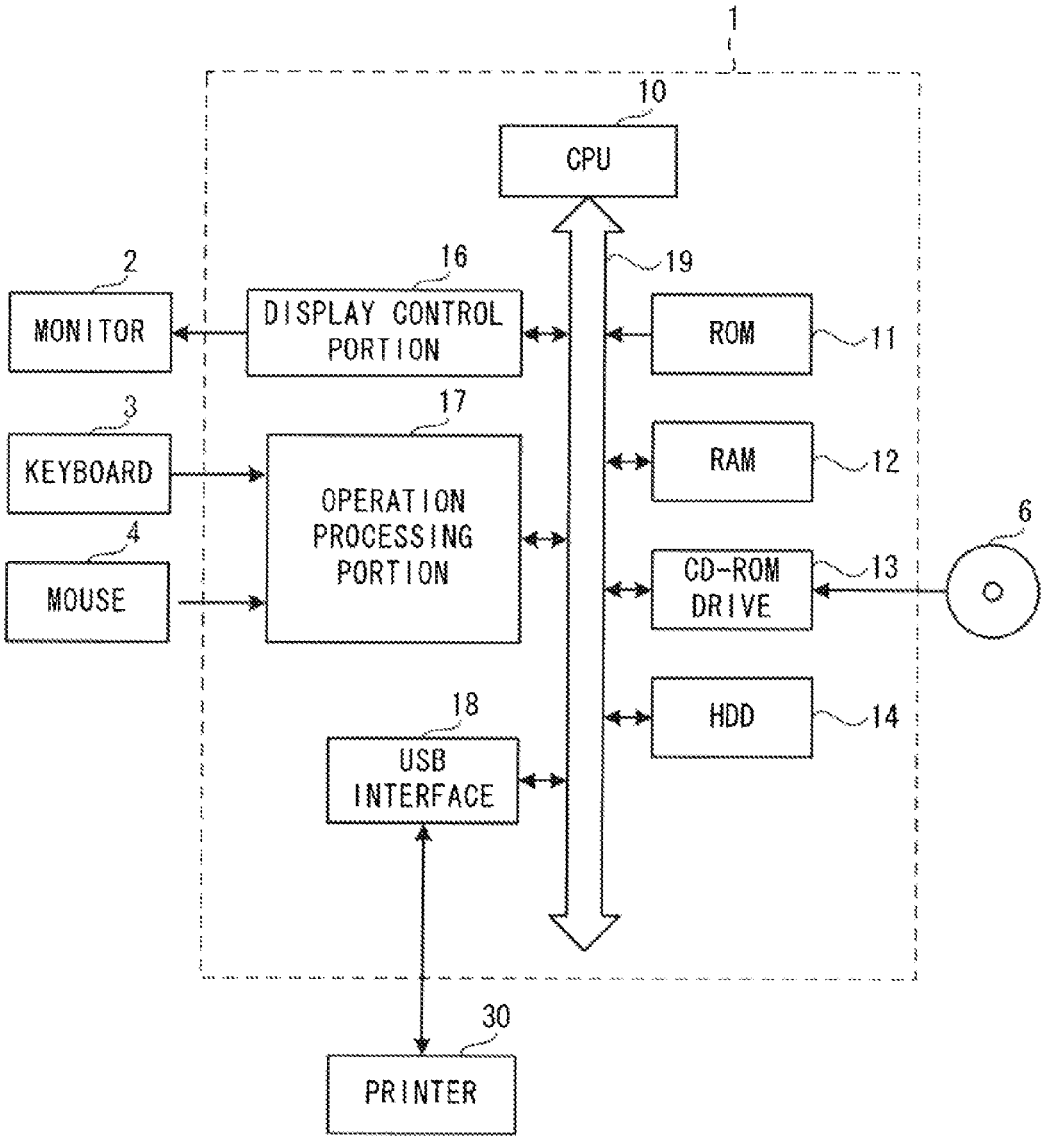
FIG. 7 is a block diagram showing an electrical configuration of a personal computer (PC)

An electrical configuration of the PC 1 will be explained with reference to FIG. 7. The PC 1 includes a CPU 10 that performs overall control of the PC 1. A ROM 11, a RAM 12, a CD-ROM drive 13, a hard disk drive (HDD) 14, a display control portion 16, an operation processing portion 17 and a USB interface 18 are connected to the CPU 10 via a bus 19.

Programs, such as a basic input/output system (BIOS) program to be executed by the CPU 10 may be stored in the ROM 11. The RAM 12 may temporarily store various types of information. A CD-ROM 6, which is a recording medium, may be inserted into the CD-ROM drive 13. Data recorded on the CD-ROM 6 may be read out by the CD-ROM drive 13. The PC 1 may acquire a print data generation program and the like via the CD-ROM 6 or the Internet etc., and store the acquired program and the like in the HDD 14. The HDD 14 is a nonvolatile storage device. The HDD 14 may store the print data generation program and various tables (refer to FIG. 8, for example). The display control portion 16 is configured to control display of a monitor 2. The operation processing portion 17 is connected to a keyboard 3 and a mouse 4 and is configured to detect an operation input. The keyboard 3 and the mouse 4 may be used when the user performs an operation input. The USB interface 18 is configured to connect the PC 1 to an external device, such as the printer 30.

A color mode conversion table 21 will be explained with reference to FIG. 8. The color mode conversion table 21 is a table to convert image data in an sRGB format expressed by 256 gradation levels into image data in a CMYKW format expressed by 256 gradation levels. The image data in the CMYKW format expressed by 256 gradation levels will be hereinafter referred to as gradation data. In the color mode conversion table 21, CMYKW values corresponding to respective sRGB values are associated with each other. The color mode conversion table 21 may be generated using a known method and stored in advance in the HDD 14 of the PC 1. The specific structure of the table may be changed. For example, a table that may be used to convert the sRCGB values into CMYK values and a table that may be used to convert the sROB values to W values may be separately provided. The color mode may be converted through calculation or the like, without using the table.

Main processing that is performed by the PC 1 will be explained with reference to FIG. 9 to FIG. 18. As described above, the print data generation program (a printer driver program) is stored in the HDD) 14 of the PC 1. When a print data generation command is input, the CPU 10 of the PC 1 activates a printer driver in accordance with the print data generation program and performs the main processing shown in FIG. 9.

When the main processing is started, the CPU 10 performs printing condition setting processing (step S1). Printing conditions that are set by the printing condition setting processing will be explained. A number of heads used, a resolution and a maximum density are set in the printing condition setting processing.

The number of heads used is the number of the white ink heads 35W that will be used to eject the ink during a scan in the main scanning direction, among the white ink heads 35W (refer to FIG. 2) mounted on the carriage 34 of the printer 30. In the present embodiment, the carriage 34 is configured such that a maximum of four white ink heads 35W can be mounted on the carriage 34. In the printing condition setting processing, one of the values 4, 2 and 0 may be set as the number of heads used (refer to FIG. 1 to FIG. 13). The number of heads used that can be set may be equal to or less than the number of the white ink heads 35W that can be mounted on the carriage 34. Therefore, in the present embodiment, the values 3 and 1 may also be set as the number of heads used, but an explanation thereof will be omitted.

The resolution is a known printing condition and indicates a dot density. In the present embodiment, one of a resolution of 600 dpi×600 dpi and a resolution of 1200 dpi×1200 dpi may be set. However, another resolution may be set. As the resolution increases, the printing quality can be improved, although the printing time becomes longer.

The maximum density is a parameter indicating a density of the white ink that is to be ejected onto an area for which a maximum amount of the white ink is to be ejected. The user can set the maximum density taking into consideration the color of the print medium, the desired printing quality, the cost of the white ink, the printing time and the like. The PC 1 acquires the gradation data in the CMYKW format expressed by 256 gradation levels (0 to 255) in order to determine an ejection amount of each ink per unit area (dot). The maximum amount of ink is to be ejected to an area with a gradation value of 255. Accordingly, the maximum density is the density of the white ink to be ejected to the area where the value of W in the gradation data is 255. In the present embodiment, it is defined that the density of the maximum amount of the white ink that can be ejected when one of the nozzles 36 of one of the white ink heads 35W is moved once with respect to each of the dot arrays extending in the main scanning direction is 100%. Therefore, in a case where the white ink is ejected using all the four white ink heads 35W mounted on the carriage 34, the density of the white ink that can be ejected by one scan is 400%. Hereinafter, the maximum density of the white ink that can be ejected during one scan of the carriage 34 with respect to each of the dot arrays is referred to as a unit density. The unit density varies in accordance with the number of heads used. In the present embodiment, the unit density (%) can be obtained by multiplying the number of heads used by 100% (unit density=number of heads used×100%). For example, in a case where the unit density is 400% and the maximum density is set to 1000%, the printer 30 needs to move the carriage 34 three times or more with respect to each of the dot arrays. The unit of measurement used for the unit density and the maximum density is not limited to being a percentage, and any unit can be set as appropriate.

The printing condition setting processing will be explained with reference to FIG. 10 to FIG. 13. When the printing condition setting processing is started, the CPU 10 reads from the HDD 14 the number of heads used that has been set in the previous processing, as a candidate value for the number of heads used, and stores the read candidate value in the RAM 12 (step S21). The CPU 10 causes the monitor 2 to display a printing condition input screen (refer to FIG. 11 to FIG. 13) corresponding to the candidate value for the number of heads used (step S22).

Figure 11:
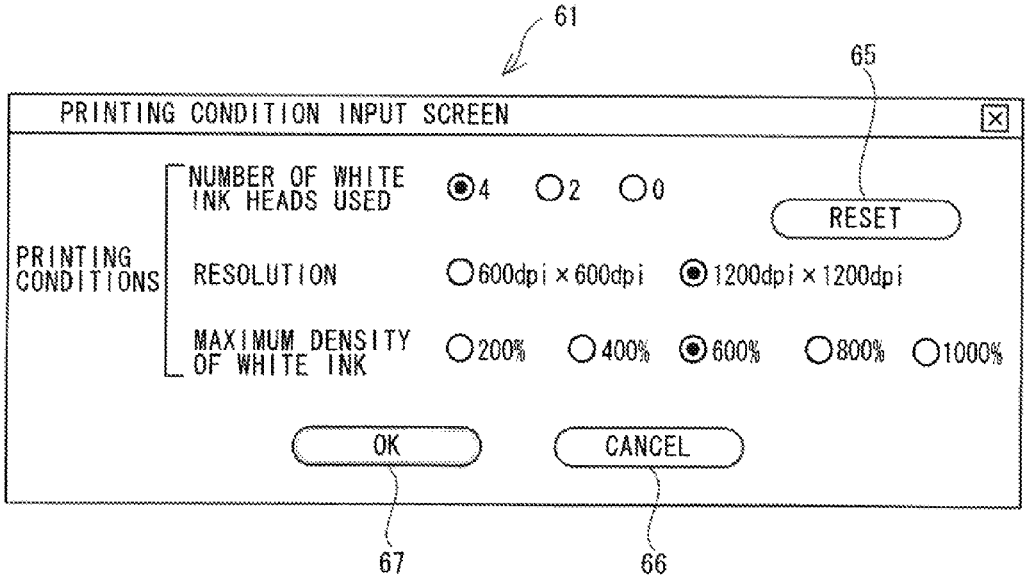
FIG. 11 is a diagram showing a printing condition input screen (an initial screen) when the number of heads used is 4.

A printing condition input screen 61 shown in FIG. 11 is an example in which the candidate value for the number of heads used is 4. In this case, the printing condition input screen 61 is displayed such that the number of heads used, the resolution and the maximum density can all be specified by the user. Further, the printing condition input screen 61 is displayed such that the maximum density can be specified from five densities within a range of 200 to 1000%.

Figure 12:
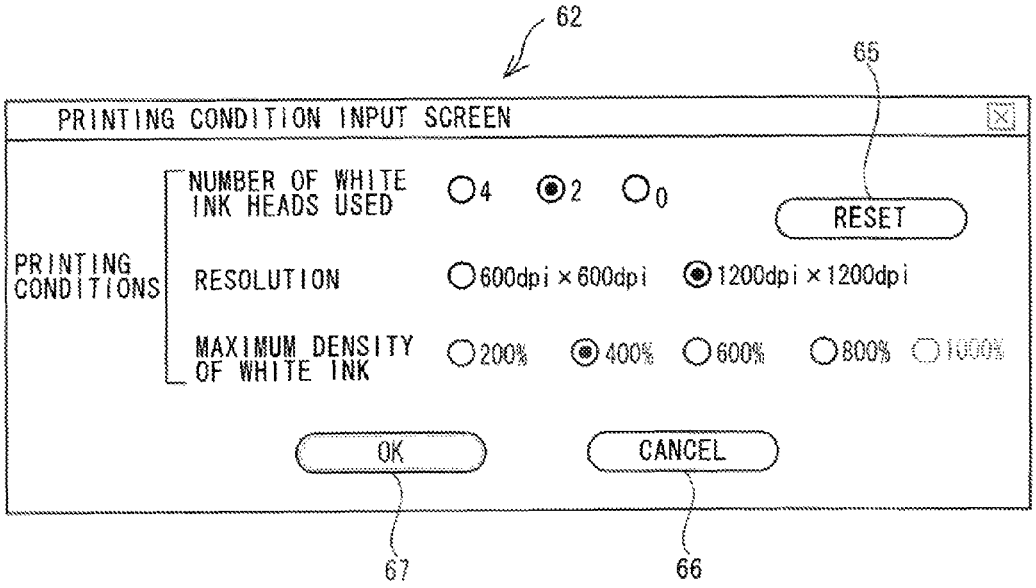
FIG. 12 is a diagram showing a printing condition input screen (an initial screen) when the number of heads used is 2.

A printing condition input screen 62 shown in FIG. 12 is an example in which the candidate value for the number of heads used is 2. In this case, in the same manner as when the candidate value is 4, the printing condition input screen 62 is displayed such that the number of heads used, the resolution and the maximum density can all be specified. However, the printing condition input screen 62 is displayed such that the maximum density can be specified from only four densities within a range of 200 to 800%. The display of the maximum density of 1000% is grayed out. That is, the CPU 10 changes the range of the maximum density that can be specified, in accordance with the number of heads used. More specifically, the CPU 10 changes the range of the maximum density such that the smaller the specified number of heads used, the lower the upper limit of the range of the maximum density. If printing with a high density is performed in a state in which the number of heads used is small, the number of scans may excessively increase, and the working efficiency may be reduced significantly. For that reason, the CPU 10 changes the range of the maximum density that can be specified, in accordance with the number of heads used. In this manner, it is possible to inhibit a printing condition that may significantly reduce working efficiency from being set by the user.

Figure 13:
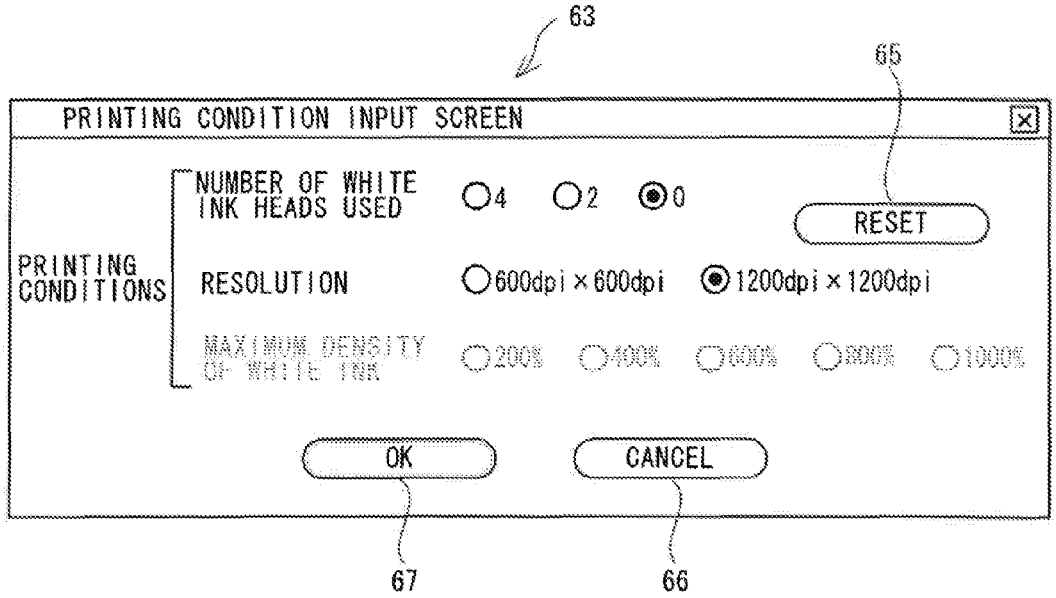
FIG. 13 is a diagram showing a printing condition input screen (an initial screen) when the number of heads used is 0.

A printing condition input screen 63 shown in FIG. 13 is an example in which the candidate value for the number of heads used is 0. In this case, the printing condition input screen 63 is displayed such that the number of heads used and the resolution can be specified. The display of the maximum density is grayed out. That is, the CPU 10 prohibits the printing condition relating only to the white ink, among the printing conditions other than the number of heads used, from being displayed and specifiable. Thus, the user can easily know that there is no need to specify the printing condition relating only to the white ink and can perform an operation appropriately.

Figure 10:
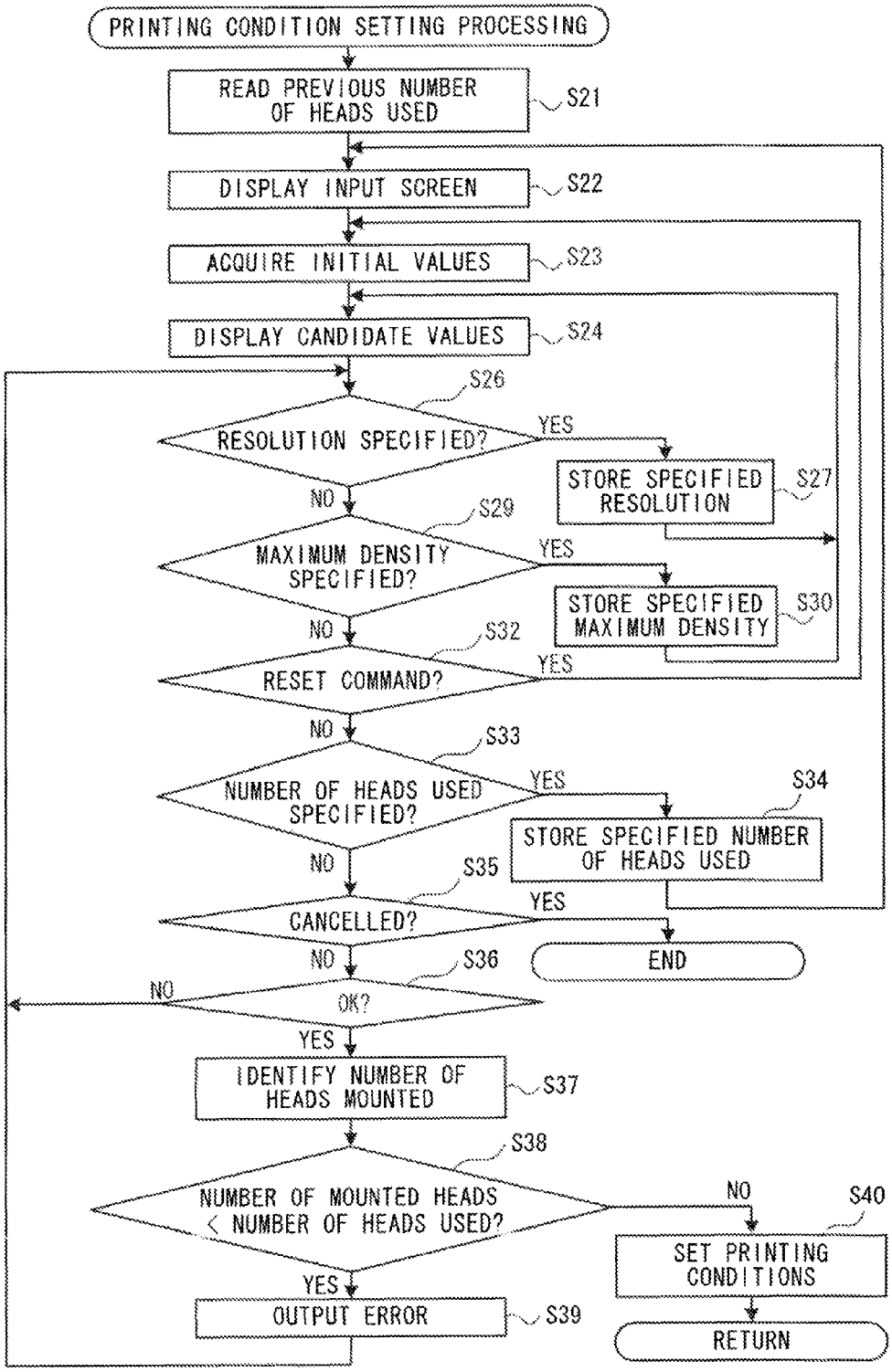
FIG. 10 is a flowchart of printing condition setting processing that is performed in the main processing.

As shown in FIG. 10, after the CPU 10 causes the printing condition input screen to be displayed (step S22), the CPU 10 acquires, from the HDD 14, initial values for the resolution and the maximum density that correspond to the number of heads used, as candidate values (step S23). The initial values for the resolution and the maximum density are stored in advance in the HDD 14 corresponding to the number of heads used. The initial values may be set for each number of heads used, taking into consideration the printing efficiency, the frequency of those initial values being specified, and the like. In the present embodiment, the initial value of the maximum density is set to 600% when the number of heads used is 4, and is set to 400% when the number of heads used is 2. The initial value of the resolution is 1200 dpi×1200 dpi regardless of the number of heads used. Since the initial values corresponding to the number of heads used are displayed, the user can easily know appropriate printing conditions that are set taking printing efficiency etc. into consideration. In a case where there are three or more values that can be specified as the number of heads used, it is not necessary that all the initial values are different for each number of heads used. The CPU 10 causes the candidate values for the number of heads used, the resolution and the maximum density to be displayed on the printing condition input screen (refer to FIG. 11 to FIG. 13) (step S24). In a case where the user wants to specify a value other than a current candidate value, the user may select a circular button that is displayed next to a desired value by operating the mouse 4 (refer to FIG. 7) or the like.

The CPU 10 determines whether or not the resolution has been specified (step S26). In a case where the resolution has been specified (yes at step S26), the CPU 10 stores the specified resolution in the RAM 12 as a candidate value (step S27), and causes the stored candidate value for the resolution to be displayed (step S24). In a case where the resolution has not been specified (no at step S26), the CPU 10 determines whether or not the maximum density has been specified (step S29). In a case where the maximum density has been specified (yes at step S29), the CPU 10 stores the specified maximum density as a candidate value (step S30), and causes the candidate value for the maximum density to be displayed (step S24).

In a case where the maximum density has not been specified (no at step S29), the CPU 10 determines whether or not a reset command has been input to return the candidate values for the printing conditions to the initial values (step S32). In a case where a reset button 65 that is provided on each of the printing condition input screens 61 to 63 (refer to FIG. 11 to FIG. 13) is operated, the CPU 10 determines that the reset command has been input. In a case where the reset command has been input (yes at step S32), the CPU 10 returns the processing to step S23. The CPU 10 once again acquires the initial values for the resolution and the maximum density that correspond to the candidate value for the number of heads used that is specified at that point in time (step S23), and causes the initial values to be displayed (step S24). More specifically, in a case where the reset command is input, the CPU 10 returns the candidate values for the resolution and the maximum density to initial values that correspond to the candidate value for the number of heads used, while maintaining the candidate value for the number of heads used. As a result, the user can easily return to the initial values just the candidate values for the printing conditions that may be changed more frequently than the number of heads used. Thus, there is no need for the user to needlessly re-specify the number of heads used.

In a case where the reset command has not been input (no at step S32), the CPU 10 determines whether or not the number of heads used has been specified (step S33). In a case where the number of heads used has been specified (yes at step S33), the CPU 10 stores the specified number of heads used as a candidate value (step S34). The CPU 10 returns the processing to step S22, and causes the printing condition input screen that corresponds to the specified number of heads used to be displayed (step S22). The CPU 10 acquires initial values that correspond to the number of heads used (step S23), and causes the initial values to be displayed (step S24). In summary, in a case where the number of heads used is changed, the printing condition input screen is changed to a screen that is suitable for the specified number of heads used. Thus, the user can easily specify the resolution and the maximum density corresponding to the specified number of heads used.

In a case where the number of heads used has not been specified (no at step S33), the CPU 10 determines whether or not a cancel command has been input (step S35). In a case where a cancel button 66 (refer to FIG. 11 to FIG. 13) is operated and the cancel command is input (yes at step S35), the CPU 10 ends the printing condition setting processing. In a case where the cancel command has not been input (no at step S35), the CPU 10 determines whether or not an OK command has been input (step S36). In a case where an OK button 67 (refer to FIG. 11 to FIG. 13) is not operated (no at step S36), the CPU 10 returns the processing to the determination processing at step S26.

In a case where the OK button 67 is operated and the OK command is input (yes at step S36), the CPU 10 identifies the number of the white ink heads 35W mounted on the carriage 34 of the printer 30 (step S37). The number of the white ink heads 35W mounted on the carriage 34 is hereinafter referred to as the number of mounted heads. Various methods can be used as a method for identifying the number of mounted heads. For example, the CPU 10 may transmit to the printer 30 a command requesting the printer 30 to output the number of mounted heads and receive data indicating the number of mounted heads that is output from the printer 30. The CPU 10 can thus identify the number of mounted heads. The user may be allowed to input data indicating the number of mounted heads mounted on the printer 30 in advance, and the CPU 10 may store the data in the HDD 14. Then, by referring to the data stored in the HDD 14, the CPU 10 may identify the number of mounted heads.

The CPU 10 determines whether or not the number of mounted heads is smaller than the candidate value for the number of heads used (step S38). In a case where the number of mounted heads is smaller than the number of heads used (yes at step S38), the printer 30 will not be able to perform printing under the specified printing conditions. Therefore, the CPU 10 outputs an error (step S39), and returns to the determination processing at step S26. As a result, the user can easily know that the specified number of heads used should be changed. Various methods, such as displaying an error screen on the monitor 2 and generating an error sound, can be used as an error output method. In a case where the number of mounted heads is not less than the number of heads used (no at step S38), the CPU 10 sets the candidate values for the number of heads used, the resolution and the maximum density that are stored in the RAM 12, as the printing conditions, and stores the set printing conditions in the HDD 14 (step S40). The CPU 10 returns to the main processing (refer to FIG. 9).

As explained above, with the printing condition setting processing, the user can freely specify the number of heads used and can cause the printer 30 to perform printing. As the number of heads used is increased, the printing can be completed in a shorter time. In a case where overprinting is performed with a reduced number of heads used, the white ink can be ejected after the previously ejected white ink has dried to a certain extent. Thus, if printing with less bleeding is desired, printing quality can be improved. Therefore, by specifying the number of heads used, the user can cause the printer 30 to perform printing in a shorter time using a large number of the white ink heads 35W. Further, the user can also inhibit ink bleeding by specifying a reduced number of the white ink heads 35W. The printing condition setting processing can be commonly used for a plurality of printers with a different number of the white ink heads 35W mounted on the carriage 34. Thus, printer manufacturers and users do not need to prepare separate printer drivers for different types of printers. Even when the number of the white ink heads 35W mounted on the carriage 34 of the printer 30 is changed, the user can easily cause the PC 1 to generate the print data by just changing the specified number of heads used.

Figure 9:
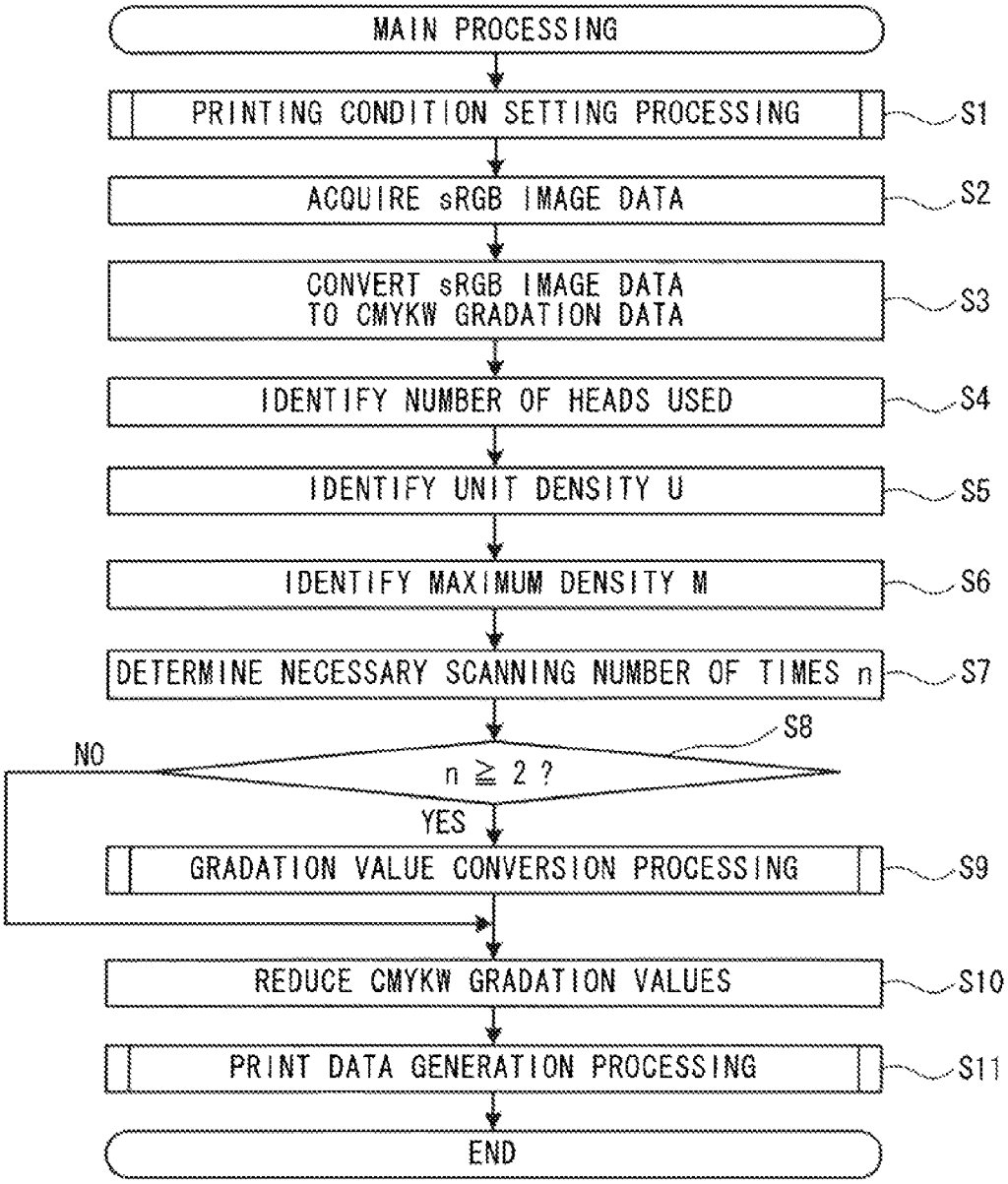
FIG. 9 is a flowchart of main processing that is performed by the PC.

As shown in FIG. 9, after the printing condition setting processing (S1) is complete, the CPU 10 acquires image data in the sRGB format expressed by 256 gradation levels (step S2). The CPU 10 converts the acquired image data into gradation data in the CMYKW format expressed by 256 gradation levels using the color mode conversion table 21 (refer to FIG. 8), and stores the gradation data (step S3). The CPU 10 identifies the number of heads used that has been set by the printing condition setting processing at step S1 (step S4). The CPU 10 identifies a unit density U that corresponds to the identified number of heads used (step S5). As described above, in the present embodiment, the unit density U is a value obtained by multiplying the number of heads used by 100. The CPU 10 identifies a maximum density M that has been set (step S6).

The CPU 10 determines a necessary scanning number of times n based on the unit density U and the maximum density M (step S7). The necessary scanning number of times n is a number of limes that the carriage 34 needs to be moved in the main scanning direction with respect to each of the dot arrays in order to eject the white ink of the maximum density M. For example, if the unit density is 400% and the maximum density is 1000%, the necessary scanning number of times n is 3. Specifically, at step S7, the CPU 10 calculates a value K based on the following formula.

$$K=(\text{maximum density } M)/(\text{unit density } U)$$

If the calculated value K is an integer, the CPU 10 determines the value K as the necessary scanning number of times n. If the calculated value K is not an integer, the CPU 10 determines, as the necessary scanning number of times n, a value obtained by adding 1 to a value obtained by rounding down the value K to the nearest integer.

In this manner, the CPU 10 can easily determine an appropriate value as the necessary scanning number of times n, regardless of the value of the maximum density M that has been set. For example, even if the user can freely and directly input the value of the maximum density M, or even if the user can finely change the value of the maximum density M by operating the mouse 4, the CPU 10 can accurately and easily determine the necessary scanning number of times n.

The CPU 10 determines whether or not the necessary scanning number of times n is 2 or more (step S8). In a case where the necessary scanning number of times is 2 or more (yes at step S8), the printer 30 will need to perform overprinting. In this case, the CPU 10 performs gradation value conversion processing (step S9). In the gradation value conversion processing, the gradation value of W is converted in order to generate common data. The common data is data that is used to set an ejection amount of the white ink for each dot. The common data will be used in common for each of a plurality of scans performed in overprinting. In a case where the necessary scanning number of times n is less than 2 (namely, 1) (no at step S8), the CPU 10 advances directly to the processing at step S10.

Figure 14:
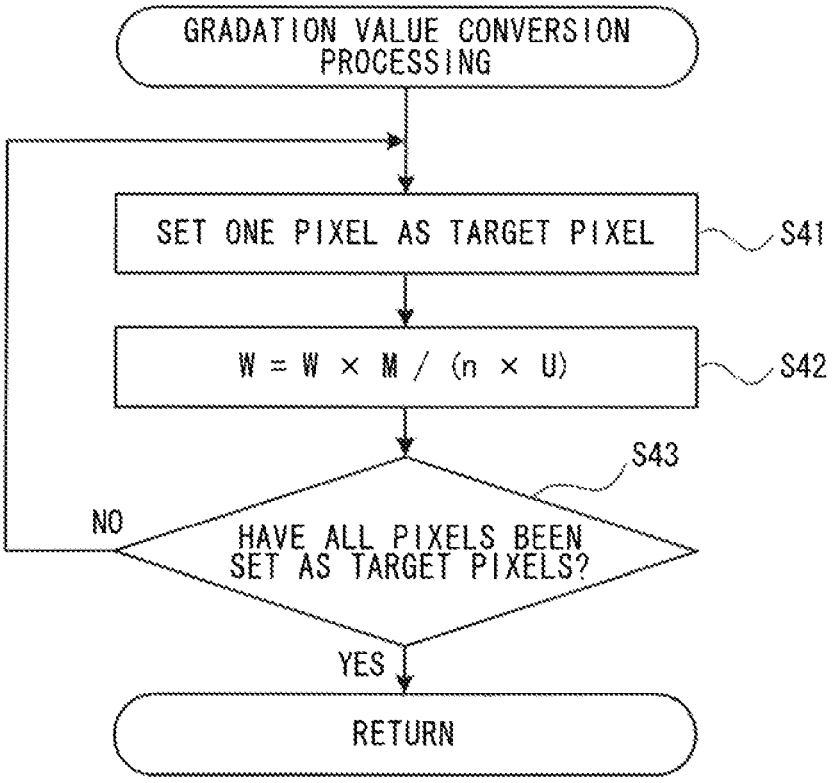
FIG. 14 is a flowchart of gradation value conversion processing that is performed in the main processing.

The gradation value conversion processing will be explained with reference to FIG. 14. The CPU 10 sets, as a target pixel, one of a plurality of pixels that form a printing area in the image data (step S41). The CPU 10 converts the gradation value W of the target pixel (step S42). Specifically, the CPU 10 calculates a value (n×U) by multiplying the necessary scanning number of times n by the unit density U. The CPU 10 then obtain the converted gradation value W by multiplying the gradation value W of the white ink of the target pixel by the ratio of the maximum density M to the obtained value (n×U). The CPU 10 determines whether or not all the pixels have been set as target pixels (step S43). In a case where all the pixels have not been set as the target pixels (no at step S43), the CPU 10 returns to the processing at step S41 and repeats the processing from step S41 to step S43. In a case where the processing is complete for the gradation values W of all the pixels (yes at step S43), the CPU 10 returns to the main processing (refer to FIG. 9).

As shown in FIG. 9, after the processing at step S58 or step S9, the CPU 10 reduces the gradation value of each of the pixels by performing error diffusion processing on the gradation data in the CMYKW format expressed by 256 gradation levels (step S10). By doing this, data in the CMYKW format with reduced gradation levels (hereinafter referred to as low gradation CMYKW data) can be obtained. In a case where the necessary scanning number of times n is two or more, the data of W with reduced gradation levels will be used as common data. The error diffusion processing is known processing that converts the data of 256 gradation levels to data of printing gradation levels. In the present embodiment, the print data is represented by the two values 1 and 0. The value 1 indicates that the ink is to be ejected. The value 2 indicates that the ink is not to be ejected. Therefore, the gradation data is converted to binary data by reducing the gradation values. However, in a case where the printer 30 can process print data of multiple levels (for example, when large/medium/small droplets can be separately ejected), the CPU 10 may convert the gradation data to data of three or more values. The CPU 10 may reduce the gradation values using a method other than the error diffusion method. Next, the CPU 10 performs print data generation processing (step S11). In the print data generation processing, print data to drive the printer 30 is generated in accordance with the low gradation CMYKW data and the set printing conditions. After the print data generation processing, the CPU 10 ends the main processing.

In a case where overprinting is performed by the printer 30, in the related art, the print data to control the operations of the printer 30 is generated for each scan of the carriage 34. Therefore, as compared to a case in which overprinting is not performed, the processing load on the PC 1 is increased and the data volume of the print data is also increased. Particularly, in a case where the PC 1 generates the print data for the multi-pass method in this manner, the PC 1 performs the thinning processing for each scan. The thinning processing is processing that controls the ejection amount of ink by thinning out the ink ejection in each of a plurality of scans in accordance with a predetermined algorithm, with respect to the dots that are set as targets of ink ejection. In a case where the thinning processing is performed for each scan, the processing load on the PC 1 is increased. In a case where a mask pattern (a thinning pattern), which is used when the thinning processing is performed, is generated for each scan, the processing load on the PC 1 is further increased. In contrast, in the present embodiment, the CPU 10 can easily generate common data of W that sets the ejection amount of the white ink for each dot. Since the generated common data can be used in common for each of scans when overprinting is performed, the data volume can be made small. The CPU 10 does not need to generate data for each scan and also does not need to perform the thinning processing for each scan. As a result, the CPU 10 can quickly generate the print data with a reduced processing load.

Figure 15:
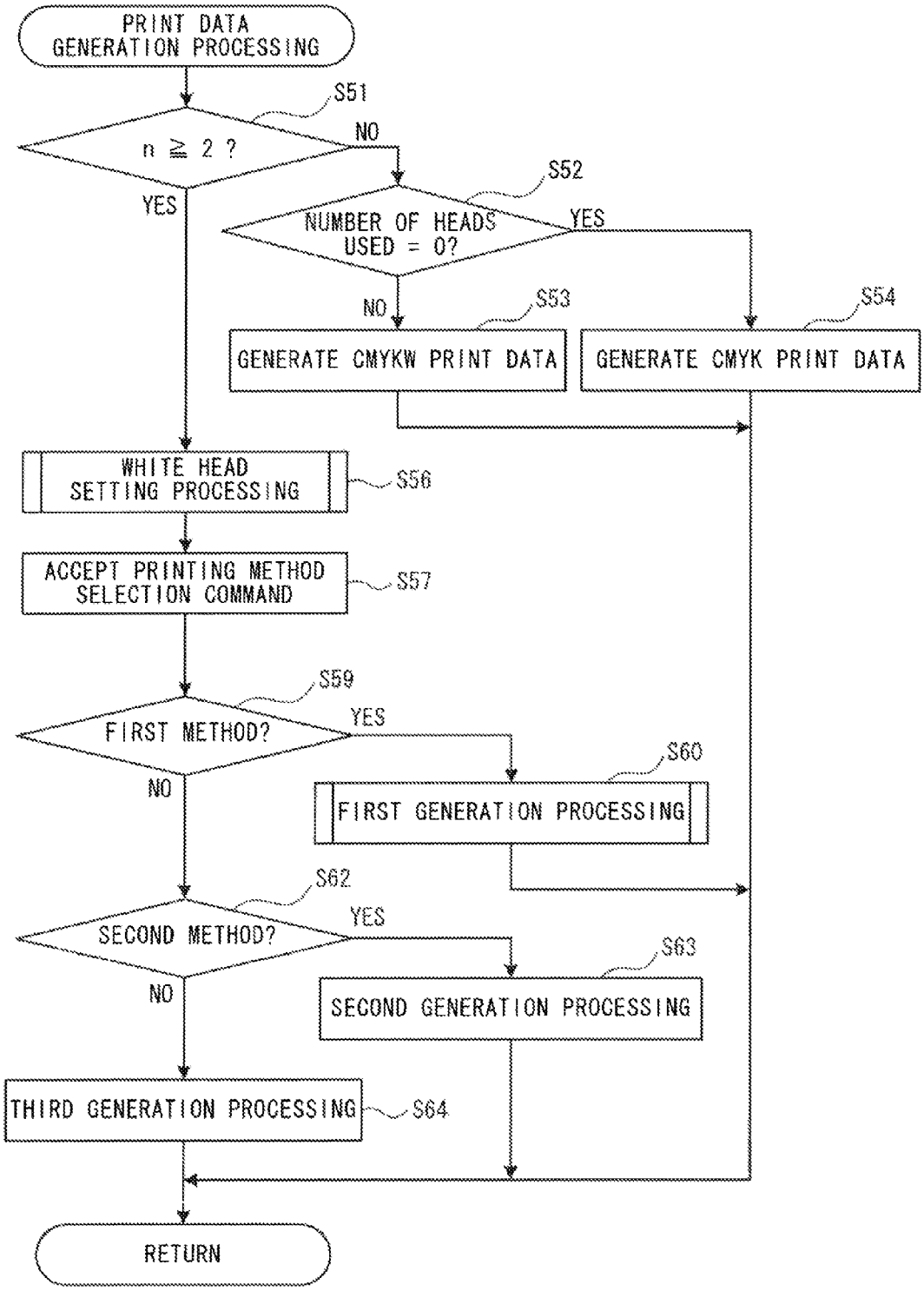
FIG. 15 is a flowchart of print data generation processing that is performed in the main processing.

The print data generation processing will be explained in more detail with reference to FIG. 15 to FIG. 18. As shown in FIG. 15, first, the CPU 10 determines whether or not the necessary scanning number of times n is 2 or more (step S51). In a case where the necessary scanning number of times is 1 (no at step S51), there is no need to change the density of the white ink to be higher than the unit density U. Therefore, the CPU 10 generates print data using the same method as in the related art (step S52 to step S54). Specifically, in a case where the number of heads used is a value other than 0 and printing with the white ink will be performed (no at step S52), the CPU 10 generates CMYKW print data from the low gradation CMYKW data (step S53). In a case where the number of heads used is 0 and printing with the white ink will not be performed (yes at step S52), the CPU 10 generates CMYK print data from the low gradation CMYKW data except the data of W (step S54). After the processing at step S53 or step S54, the CPU 10 ends the print data generation processing. In a case where settings for the multi-pass printing to be performed have been made by the user in advance, the CPU 10 generates, in the processing at step S53 or step S54, the print data to cause the printer 30 to operate using the multi-pass method. In this case, the print data generated at step S53 is not intended to change the density of the white ink to be higher than the unit density U. Therefore, when the printer 30 operates based on the print data generated at step S53, the white ink, whose density in total is the same as that of the white ink that can be ejected during one scan of the carriage 34, is ejected during a plurality of scans using the multi-pass method.

In a case where the necessary scanning number of times n is two or more and overprinting with the white ink will be performed (yes at step S51), the CPU 10 performs white head setting processing (step S56). In the white head setting processing, the white ink head(s) 35W that will be caused to eject the ink in each scan, namely, the white ink head(s) 35W to be used, is set from among the white ink heads 35W mounted on the carriage 34.

Figure 16:
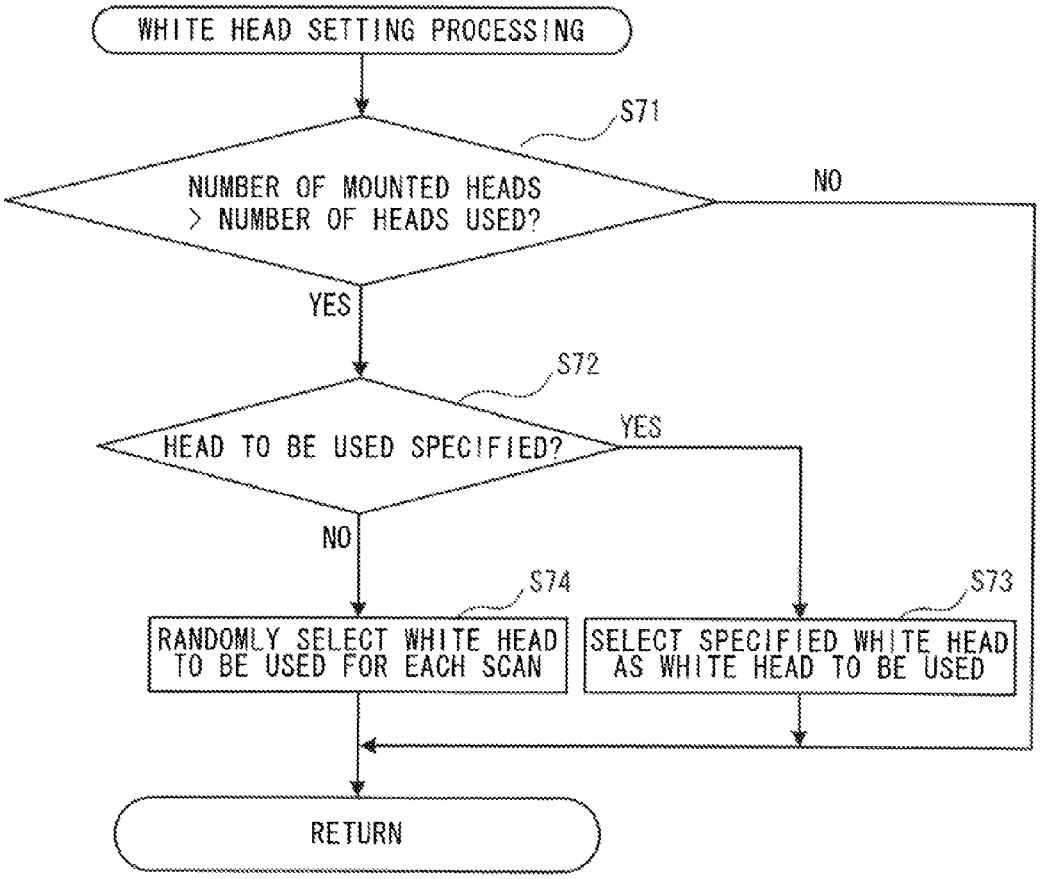
FIG. 16 is a flowchart of white head setting processing, which is performed in the print data generation processing.

As shown in FIG. 16, the CPU 10 determines whether or not the number of mounted heads (refer to step S37 in FIG. 10) is larger than the number of heads used (step S71). In a case where the number of mounted heads is the same as the number of heads used (no at step S71), all the white ink heads 35W mounted on the carriage 34 will be used in all the scans. Therefore, the CPU 10 returns directly to the print data generation processing (refer to FIG. 15).

In a case where the number of mounted heads is larger than the number of heads used (yes at step S71), the CPU 10 determines whether or not the head(s) to be used has been specified (step S72). In a case where the user wants to use particular one or some of the white ink heads 35W, the user may input, to the PC 1 in advance, information that specifies the white ink head or heads 35W to be used. For example, if some of the while ink heads 35W are not functioning, the user can specify one or some of the white ink heads 35W that are functioning, as the head or heads to be used. In a case where the head(s) to be used has been specified (yes at step S72), the CPU 10 identifies the specified white ink head(s) 35W as the white ink head(s) 35W to be used in all the scans (step S73). The CPU 10 returns to the print data generation processing.

In a case where the head(s) to be used has not been specified (no at step S72), the CPU 10 randomly selects, from among the white ink heads 35W mounted on the carriage 34, the same number of the white ink heads 35W as the number of heads used for each of the scans that will be performed. The CPU 10 sets the randomly selected white ink heads 35W as the heads to be used (step S74). The CPU 10 returns to the print data generation processing. Due to the processing at step S74, the PC 1 will generate the print data to perform printing while the white ink heads 35W that eject the white ink are changed for each scan. Therefore, the PC 1 can inhibit the ink from drying on the nozzles 36 as a result of a particular one of the white ink heads 35W not being used for a long time, and it is thus possible to improve printing quality. The possibility of ink clogging may also be reduced.

As shown in FIG. 15, after the white head setting processing (step S56), the CPU 10 accepts a printing method selection command (step S57). More specifically, the CPU 10 causes the monitor 2 to display the following three printing methods for overprinting, in a selectable manner. The three methods are a first method (the multi-pass method), a second method (a method that prioritizes prevention of bleeding), and a third method (a method that prioritizes white color development). The user may operate the mouse 4 etc. and input a command to select one of the printing methods to the PC 1. In a case where the first method is selected (yes at step S59), the CPU 10 performs first generation processing (step S60), and ends the print data generation processing. Although details will be described later, in the first generation processing, print data to cause the printer 30 to perform printing using the first method is generated from the low gradation CMYKW data.

In a case where the selected printing method is not the first method (no at step S59) but the second method (yes at step S62), the CPU 10 performs second generation processing (step S63) and ends the print data generation processing. In the second generation processing. CMYKW print data to cause the printer 30 to repeatedly perform a whole version of white color printing a plurality of times is generated from the low gradation CMYKW data (refer to FIG. 4). As described above, the data of W among the low gradation CMYKW data is the common data. In the second method, if the necessary scanning number of times n is four, for example, after the printer 30 repeats three times a printing operation of a version of white color only, the printer 30 performs simultaneous printing of a white color version and a color version in the fourth scan and ends the printing. That is, in the final unit operation, the printer 30 ejects the color inks onto the overprinted white ink using the color ink heads 35CL while performing n-th overlay ejecting of the white ink using the white ink heads 35W. It is also possible that the printer 30 repeats n times a unit operation that performs printing of the white ink only using the white ink heads 35W, and thereafter performs a unit operation once using the color ink heads 35CL only. With the second generation processing, the PC 1 can generate the print data that may suppress ink bleeding and develop a stable color.

In a case where the selected printing method is the third method (no at step S62), the CPU 10 generates CMYKW print data from the low gradation CMYKW data in third generation processing (step S64), and ends the print data generation processing. The data of W among the low gradation CMYKW data is the common data. With the print data generated by the third generation processing, after the printer 30 has completed the ejection of the white ink with respect to one dot array by performing scans n times, then, with respect to the next dot array, the printer 30 causes the white ink to be ejected by performing scans n times in the same manner (refer to FIG. 5). The color inks are ejected in any one of the scans performed n times when the color ink heads 35CL are disposed above the dot array for which the white ink printing has already been completed, along with the movement of the platen 39 to the downstream side in the feed direction. With the print data generated by the third generation processing, it is possible to inhibit the generation of gaps by blurring the ink moderately and it is possible to obtain good color development.

The first generation processing will be explained with reference to FIG. 17. Characteristics of the print data for the multi-pass method that is generated by the first generation processing will be explained. As described above, in the multi-pass printing, the printing is performed such that a different one of the nozzles 36 is used every time a scan is performed with respect to each of the dot alleys. Therefore, the influence of various variations can be reduced and printing quality can be improved. In the multi-pass printing, as the number of times that the different nozzles 36 are moved with respect to the same dot array is increased (namely, as the number of the nozzles 36 that form one dot array is increased), the influence of variations can be notably reduced. Hereinafter, the number of times that the different nozzles 36 are moved with respect to the same dot array is referred to as the number of passes. The first generation processing is intended to improve printing quality, using the above-described characteristics. Generally, the number of passes that can be set in multi-pass printing is limited in accordance with the number of the nozzles 36 provided on each of the ink heads 35. This is because, unless the number of passes is a divisor (except 1) of the number of the nozzles 36, control of the multi-pass printing becomes complicated. In the present embodiment, the number of the nozzles 36 provided on each of the ink heads 35 is 128. Therefore, the number of passes that can be set is limited to the divisors of 128, except 1 (namely, 2, 4, 8, 16, 32, 64 and 128). Therefore, in a case where the necessary scanning number of times n matches none of the number of passes that can be set in multi-pass printing, it is necessary to cause the printer 30 to perform overprinting using a method in which multi-pass printing is performed a plurality of times, or a method in which multi-pass printing and normal printing are both performed. In this case, in the first generation processing, optimal print data is generated by taking account of both the printing quality and the printing efficiency.

Figure 17:
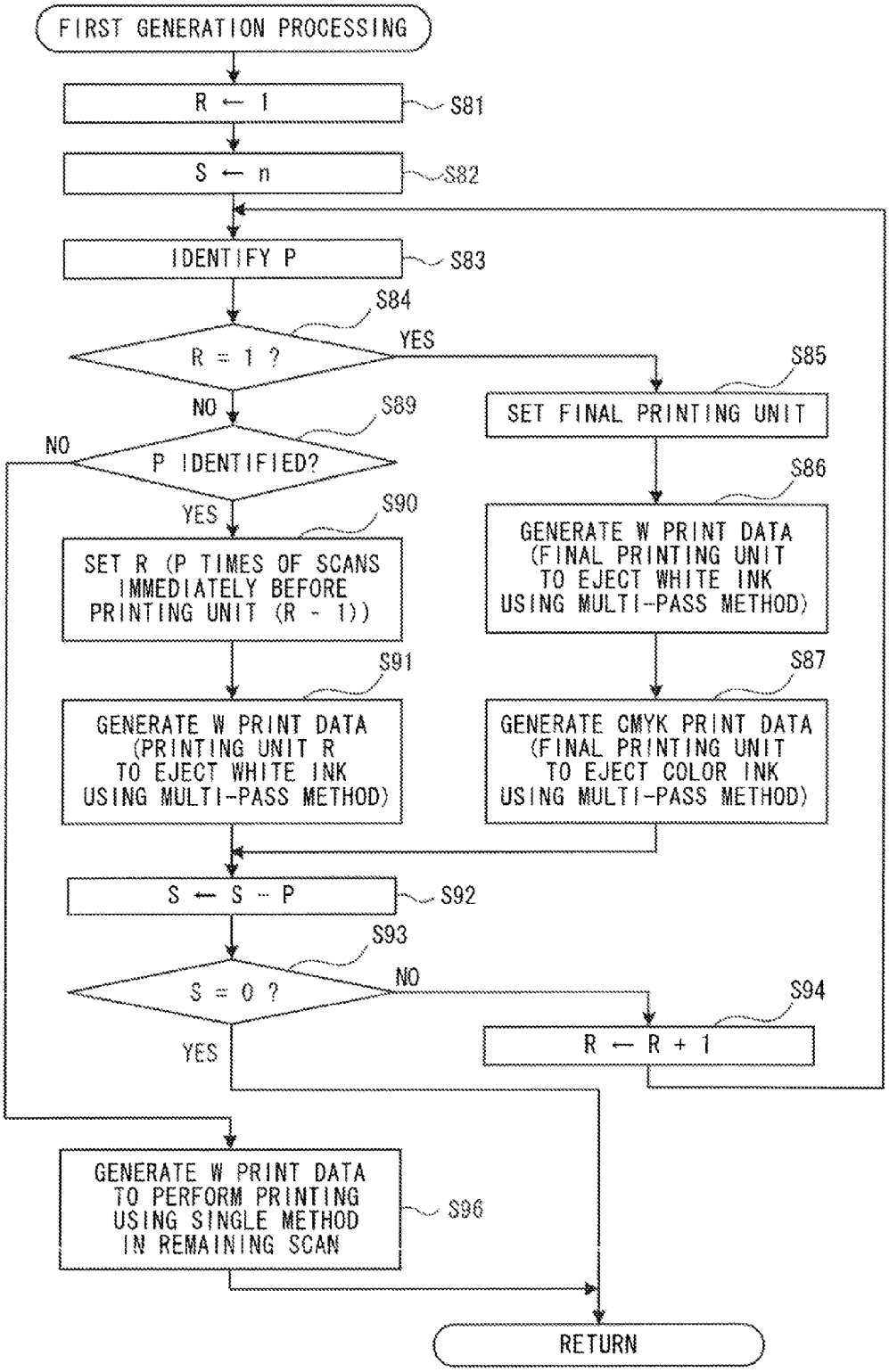
FIG. 17 is a flowchart of first generation processing that is performed in the print data generation processing.
Figure 18:
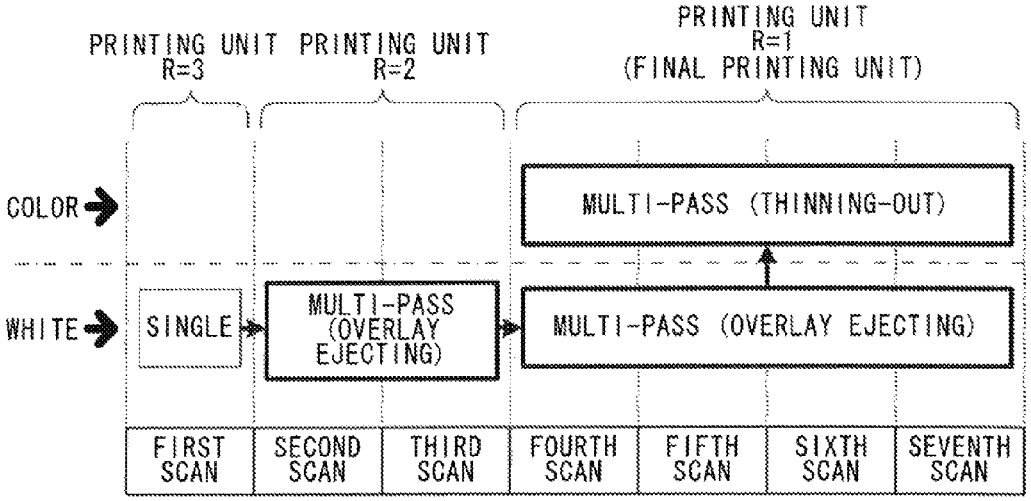
FIG. 18 is an explanatory diagram illustrating a printing operation that is performed when a necessary scanning number of times is seven.

As shown in FIG. 17, when the first generation processing is started, the CPU 10 sets a printing unit number R to 1 (step S1). In the explanation below, in a case where printing is performed using a single method without performing multi-pass printing, one scan that is performed using the single method is taken as one unit of printing. The single method is a method in which printing is performed by moving one of the nozzles 36 provided on each of the ink heads 35 once with respect to one dot array. Further, a plurality of scans that are performed using the multi-pass method by the set number of passes are collectively taken as one unit of printing. For example, in the example shown in FIG. 18, four scans that are performed using the multi-pass method (i.e., the fourth scan to the seventh scan) are collectively taken as one unit of printing (R=1). Two scans that are performed using the multi-pass method (i.e., the second scan and the third scan) are collectively taken as one unit of printing (R=2). The first scan that is performed using the single method is taken as one unit of printing (R=3).

The CPU 10 sets a remaining processing number S to the necessary scanning number of times n (step S82). The remaining processing number S is the number of scans for which corresponding print data has not yet been generated (namely, scans to which print data is to be assigned), among the plurality of scans that are to be performed the necessary scanning number of times n.

The CPU 10 identifies a number of passes P which is the largest among the numbers of passes that can be set and which is not more than the remaining processing number S (step S83). As described above, in the present embodiment, the number of passes that can be set is limited to the divisors of 128, except 1, and one of the seven numbers 2, 4, 8, 16, 32, 64 and 128 can be set. As in the example shown in FIG. 18, in a case where the necessary scanning number of times n is 7, the value of the remaining processing number S that has been set at step S82 is 7. In this case, the value 4, which is the largest value among the divisors of 128 and which is equal to or less than the remaining processing number S, is identified as the first number of passes P.

The CPU 10 determines whether or not the set printing unit number R is 1 (step S84). In a case where the printing unit number R is 1 (yes at step S84), the CPU 10 sets, as a final printing unit, P times of continuous scans including the final (n-th) scan, among the scans that are to be performed the necessary scanning number of times n (step S85). The final printing unit is a unit of printing to be performed at the end of the printing operation. The CPU 10 generates W print data for the final printing unit to cause the printer 30 to eject white ink, whose density will be made higher than the unit density U, using the multi-pass method (step S86). In the processing at step S86, although the common data of W is used in common for all of the P times of scans included in the final printing unit, the W print data is generated to operate the printer 30 such that the nozzle 36 that ejects the white ink to each dot array is different for each scan. Thus, with the use of the common data, the CPU 10 can easily generate the W print data with a reduced data volume, without performing the thinning processing. From the data of CMYK among the low gradation CMYKW data, the CPU 10 generates CMYK print data for the final printing unit to cause the printer 30 to eject the color inks, whose density will be a normal density that is equal to or lower than the unit density U, using the multi-pass method (step S87). In the processing at step S87, the thinning processing is performed for each scan. The thinning processing is known processing and thus an explanation thereof is omitted.

The CPU 10 subtracts, from the remaining processing number S, the number of passes P for which the print data assignment is complete (step S92). The CPU 10 determines whether or not the remaining processing number S is 0 (step S93). In a case where the remaining processing number S is not 0 (no at step S93), the CPU 10 adds 1 to the printing unit number R (step S94) and returns to the processing at step S83. In the example shown in FIG. 18, the remaining processing number S becomes 3 in the processing at step S92 that is performed in the first cycle. Thus, in the processing at step S83 that is performed in the second cycle, 2 is identified as the number of passes P which is the largest and which is equal to or lower than the remaining processing number S.

In a case where the printing unit number R is not 1 (no at step S84), the CPU 10 determines whether or not the number of passes P has been identified by the processing at step S83 performed immediately before step S84 (step S89). In a case where the number of passes P has been identified (yes at step S89), the CPU 10 sets, as the printing unit number R, the continuous P times of scans to be performed immediately before the unit of printing whose printing unit number is (R . . . 1) (namely, the unit of printing that has been processed last time) (step S90). In the example shown in FIG. 18, as the unit of printing whose printing unit number R is 2, the second scan and the third scan are set that are to be performed immediately before the unit of printing (the final printing unit) whose printing unit number R is 1 and which has been processed last time. The CPU 10 generates W print data for the set unit of printing to cause the printer 30 to eject the white ink, whose density will be made higher, using the multi-pass method (step S91). As a result, a plurality of sets of multi-pass printing will be performed by the printer 30. The CPU 10 advances to the processing at step S92.

In a case where the number of passes P has not been identified by the processing at step S83, it is not possible to perform the multi-pass printing in the remaining scan(s). In a case where the printing can be completed using the multi-pass method only, it is necessary that the necessary scanning number of times n matches one of the numbers of passes that can be set, or matches the sum of at least two of the numbers of passes that can be set. In a case where the number of passes P has not been identified (no at step S89), the CPU 10 generates W print data for the remaining scan(s) (the first scan in the example shown in FIG. 18) to cause the printer 30 to perform printing using the single method (step S96). The CPU 10 ends the first generation processing. In this manner, the PC 1 can easily generate the print data that allows good printing quality to be obtained, regardless of the necessary scanning number of times n. In the example shown in FIG. 18, the remaining processing number S becomes 1 in the processing at step S92 that is performed in the second cycle. Therefore, the number of passes P is not identified by the processing at step S83 that is performed in the third cycle, and in the processing at step S96, W print data for the unit of printing whose printing unit number R is 3 (namely, the first scan) is generated that causes the printer 30 to perform printing using the single method. When the remaining processing number S becomes 0 as a result of subtracting the number of passes P for which the print data assignment is complete from the remaining processing number S (yes at step S93), the processing is complete for all the scans to be performed n times. Therefore, the CPU 10 ends the first generation processing.

There are various methods for combining the single method and the multi-pass method at step S96. For example, print data that causes the nozzle 36 of the white ink to move once with respect to all the dot arrays may be generated before the multi-pass printing is performed. The single method and the multi-pass method may be combined by repeating the first scan in the main scanning direction that is performed for the first time in the multi-pass method, without moving the print medium in the sub-scanning direction. In the example shown in FIG. 18, for example, the CPU 10 may generate print data that causes the printer 30 to operate in the following manner. In the first scan, the printer 30 uses one of the nozzles 36 for the white ink to eject the white ink once for all the dot arrays using the single method. Next, the printer 30 performs multi-pass printing in which the number of passes is 2, and performs overlay ejecting with just the white ink twice. Further, the printer 30 performs multi-pass printing in which the number of passes is 4, and performs overlay ejecting of the white ink and ejecting of the thinned-out color inks at the same time. The white ink heads 35W are located on the upstream side with respect to the color ink heads 35CL in the feed direction of the platen 39. Therefore, the white ink heads 35W enter the printing area ahead of the color ink heads 35CL. As a result, the color inks are ejected onto the printing area on which the printing with the white ink has been completed.

With the print data that is generated by the first generation processing of the present embodiment, the printer 30 ejects both the white ink (the high density ink) and the color inks (the normal density ink) during a plurality of scans (the final printing unit) including the final scan, among the plurality of scans that are performed n times. As a result, at least the topmost surface of the white printing surface is formed by the multi-pass printing. Accordingly, the printing quality of the white ink can be improved. The printer 30 also ejects the color inks in the multi-pass printing in the final printing unit. Accordingly, the printing quality of the color inks can also be improved. Further, the printer 30 performs the multi-pass printing in the process of overprinting to increase the density of the white ink. Therefore, there is no need to increase the number of scans of the carriage 34 in the main scanning direction, and the printing efficiency can also be maintained high. Even in a case where the minimum value (2 in the present embodiment) of the number of passes that can be set does not match the necessary scanning number of times n for overprinting, the PC 1 can generate the print data that causes the printer 30 to perform both the white ink printing and the color ink printing efficiently, with good printing quality.

With the print data generated by the first generation processing of the present embodiment, in a case where the printer 30 performs a plurality of sets of multi-pass printing, the number of passes of multi-pass printing of the final set (the final printing unit) is the largest among the numbers of passes of the plurality of sets of multi-pass printing. As a result, the topmost surface of the white ink and the color ink are formed by multi-pass printing with an increased number of passes. Thus, the PC 1 can generate the print data that causes the printer 30 to efficiently perform printing with higher quality. In addition, with the print data generated by the first generation processing of the present embodiment, the printer 30 performs an increased number of multi-pass printing with an increased number of passes. Therefore, the PC 1 can improve the printing quality as compared to a case in which an increased number of sets of multi-pass printing with a reduced number of passes is performed.

Figure 19:
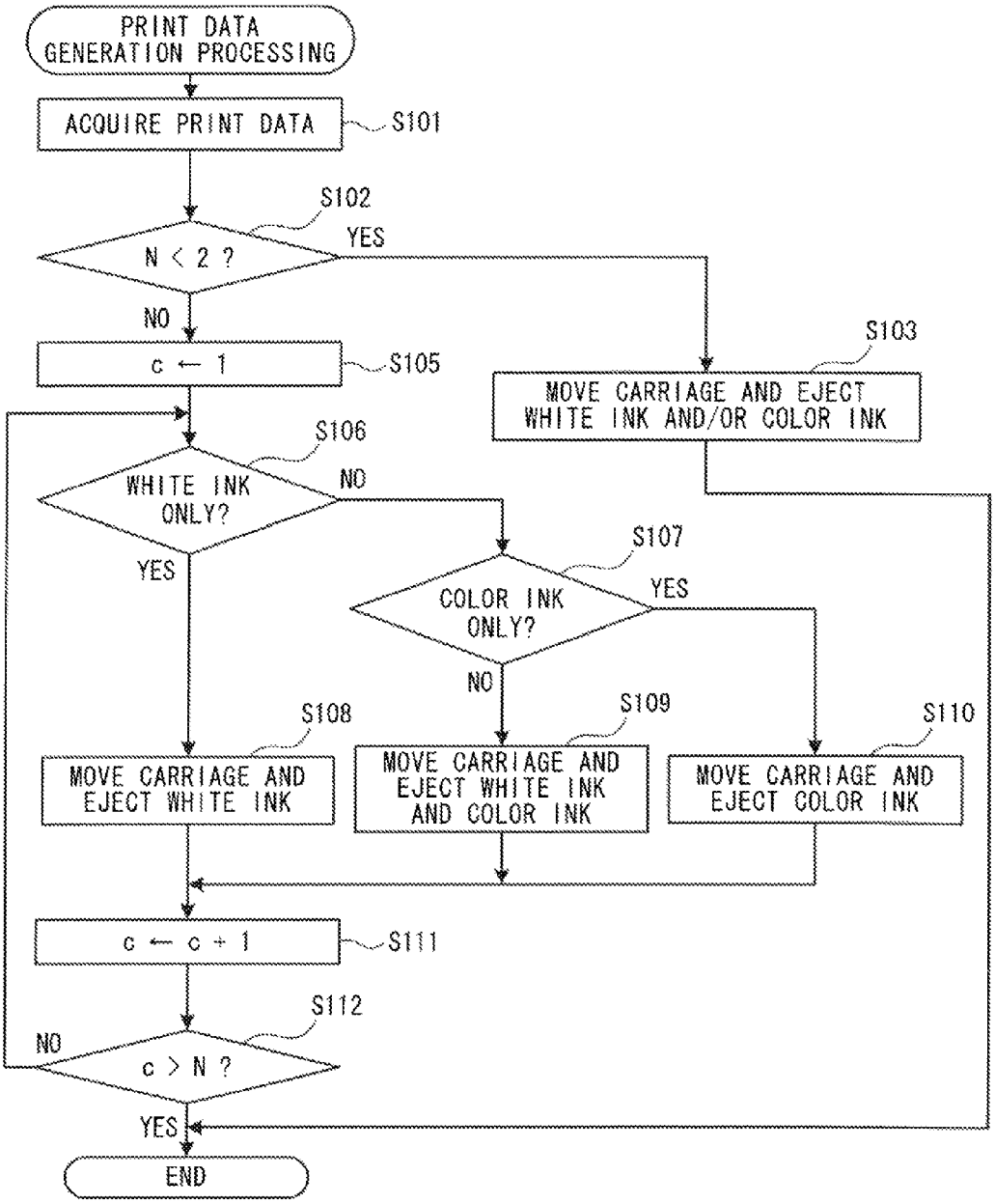
FIG. 19 is a flowchart of print processing that is performed by the printer.

Next, print processing that is performed by the printer 30 will be explained below with reference to FIG. 19. As described above, the various programs to control the operations of the printer 30 are stored in the ROM 41 of the printer 30. When a printing execution command is input from the operation panel 51, for example, the CPU 40 of the printer 30 activates a program for the print processing, and performs the print processing shown in FIG. 19. The CPU 40 may start the print processing when the printer 30 receives print data from an external device, such as PC 1, via the USB interface 52.

The CPU 40 acquires the print data of an object to be printed (step S101). Note that the print data that has been received from an external device, such as PC 1, may be stored in the RAM 42. The CPU 40 identifies the number of scans N based on the print data, and determines whether or not the number of scans N is less than 2 (step S102). The number of scans N is a number of times that the carriage 34 will be moved in the main direction to complete the printing. In a case where the number of scans N is less than 2, namely, in a case where the number of scans is 1 (yes at step S102), the CPU 40 performs printing by causing at least one of the white ink and the color ink to be ejected onto the print medium while the carriage 34 is moved once in the main scanning direction (step S103).

More specifically, the CPU 40 generates, in accordance with the print data, drive signals to drive the main scanning motor 46, the sub-scanning motor 47 and the piezoelectric elements of the ink heads 35, respectively, and outputs the generated drive signals to the motor drive portion 45 and the head drive portion 43. Thus, the CPU 40 may control the movement of the carriage 34, the movement of the print medium that is placed on the platen 39, and the ejection of the ink from the ejection ports of the nozzles 36. At step S103, during one scan, only the white ink, only the color inks, or both of the white ink and the color inks are ejected. After ejecting the ink during one scan. The CPU 40 ends the print processing shown in FIG. 19.

In a case where the number of scans N is not less than 2 (no at step S102), the CPU 40 sets a variable c stored in the RAM 42 to an initial value of 1 (step S105). The variable c is a variable to sequentially process the print data and indicates the number of the scan that is the current processing target, among the plurality of scans. The CPU 40 identifies data that corresponds to the scan (the first scan in the first cycle of the processing) that is indicated by the variable c, among the print data that has been acquired at step S101, and determines whether or not the identified data is data for ejecting only the white ink (step S106).

More specifically, in a case where the first generation processing (step S60) has been performed in the print data generation processing (refer to FIG. 15), the print data has been generated that causes the printer 30 to eject only the white ink using the single method or the multi-pass method (yes at step S106). In a case where the second generation processing (step S63) has been performed, the print data has been generated that causes the printer 30 to print the version of the white ink only during a scan in the early phase (yes at step S106). In a case where the third generation processing (S64) has been performed, the print data has been generated that causes the printer 30 to eject only the white ink a plurality of times with respect to one dot array during a scan in the early phase (yes at step S106). In any one of these cases, the CPU 40 performs printing by ejecting the white ink onto the print medium while the carriage 34 is moved once in the main scanning direction (step S108). Specifically, the CPU 40 generates, in accordance with the data that corresponds to the c-th scan, drive signals to drive the main scanning motor 46, the sub-scanning motor 47 and the piezoelectric elements of the ink heads 35, respectively, and outputs the generated drive signals to the motor drive portion 45 and the head drive portion 43. Thus, the CPU 40 may control the movement of the carriage 34, the movement of the print medium that is placed on the platen 39, and the ejection of the ink from the ejection ports of the nozzles 36. At step S108, during one scan, only the white ink is ejected.

After the white ink is ejected during the scan, the CPU 40 adds 1 to the variable c stored in the RAM 42 (step S11), thereby sets the data that corresponds to the next scan as the processing target. The CPU 40 determines whether or not that the variable c exceeds the number of scans N (step S112). In a case where the variable c does not exceed the number of scans N (no at step S112), the printing has not been completed. Therefore, the CPU 40 returns to the processing at step S106.

In a case where the data that corresponds to the scan that is indicated by the variable c is not the data for causing only the white ink to be ejected (no at step S106), the CPU 40 determines whether or not the data is data for causing only the color inks to be ejected (step S107). In a case where the processing target data is data for causing the color inks as well as the white ink to be ejected (no at step S107), the CPU 40 performs printing by ejecting the white ink and the color inks onto the print medium while the carriage 34 is moved once in the main scanning direction (step S109). The processing at step S109 is similar to the processing at step S108, except that the both the white ink and the color inks are ejected during one scan at step S109.

Note that the color inks are ejected by the color ink heads 35L that are disposed on the downstream side in the feed direction of the print medium onto the white ink that has been ejected onto the print medium in advance by the white ink heads 35W that are disposed on the upstream side.

After the white ink and the color inks are ejected during the scan, the CPU 40 adds 1 to the variable c that is stored in the RAM 42 (step S111), thereby sets the data that corresponds to the next scan as the processing target. In a case where the variable c does not exceed the number of scans N (no at step S112), the CPU 40 returns to the processing at step S106. In a case where the data that corresponds to the scan that is indicated by the variable c is data for causing only the color inks to be ejected (yes at step S107), the CPU 40 performs printing by ejecting only the color inks onto the print medium while the carriage 34 is moved once in the main scanning direction (step S110). The processing at step S110 is similar to the processing at step S108, except that only the color inks are ejected during one scan at step S110. Note that, as in step S109, the color inks are ejected by the color ink heads 35L onto the white ink that has been ejected onto the print medium in advance by the white ink heads 35W. When the variable c exceeds the number of scans N (yes at step S112), as a result of repeating the processing of steps S106 to S112, the CPU 40 determines that printing is complete and ends the print processing shown in FIG. 19.

In the printer 30, the ejection port group (the white ink heads 35W in the present embodiment) that can eject the white ink is located on the upstream side of the ejection port groups (the color ink heads 35CL in the present embodiment) that can eject the color inks. Therefore, the print medium that is fed by the driving of the sub-scanning motor 47 reaches a position that corresponds to the ejection port group for the white ink before the print medium reaches a point that corresponds to the ejection port groups for the color inks. For that reason, the printer 30 can efficiently perform the processing of ejecting the color inks onto the dot array onto which the white ink has been ejected a plurality of times.

Various modifications can be made to the above-described embodiment. The above-described embodiment is an example in which the processing for setting the printing conditions and the processing for generating the print data are performed by the PC 1 that is an external device to the printer 30. However, an apparatus that can operate as an apparatus for generating the print data is not limited to the PC 1. For example, the printer 30 (more specifically, the CPU 40) may generate the print data by performing the main processing shown in FIG. 9. In such a case, the CPU 40 of the printer 30 may first generate the print data through the main processing shown in FIG. 9 and then the CPU 40 may perform the print processing shown in FIG. 19 when the print execution command is input.

The processing shown in FIG. 9 to FIG. 18 may be performed by a plurality of apparatuses included in the printing system 100. For example, in the above-described embodiment, in a case where the number of mounted heads is smaller than the candidate value for the number of heads used, the PC 1 outputs an error (refer to step S38 and step S39 in FIG. 10). However, the PC 1 need not necessarily output an error. More specifically, the PC 1 may generate the print data without performing the processing at step S38 and step S39 shown in FIG. 10 and may transmit the generated print data to the printer 30. The CPU 40 of the printer 30 may read the number of heads used from the received print data, and in a case where the number of mounted heads is smaller than the number of heads used, the printer 30 may output an error. The printer 30 may store the number of mounted heads in advance. The printer 30 may identify the number of mounted heads using a switch, a sensor or the like that is configured to detect the mounting of the white ink heads 35W. It is also possible that the PC 1 performs the printing condition setting processing (step S1) of the main processing (refer to FIG. 9) and the printer 30 performs the processing from step S2 to step S11. In this case, the PC 1 may transmit the set printing conditions to the printer 30. The printing system 100 may include two personal computers 1. In this case, the first PC 1 may perform the printing condition setting processing (step S1) and the second PC 1 may perform the processing from step S2 to step S11, for example. As described above, each of the processing steps explained in the above-described embodiment may be performed by any one of the apparatuses included in the printing system 100, or may be divided and performed by the apparatuses.

It is needless to mention that the format and the gradation levels etc. of the various types of data, such as image data, can be changed. For example, the format of the image data that is acquired by the PC 1 at step S2 shown in FIG. 9 is not limited to the data in the sRGB format, and the gradation levels is also not limited to 256 levels. In the same manner, the data format and the gradation levels of the gradation data need not necessarily be limited to the CMYKW format and 256 levels. Another color (for example, orange) other than cyan, magenta, yellow, black and white may be used. It is also possible for the print data to have multiple values (three or more gradation levels). The PC 1 may directly acquire the gradation data in the CMYKW format from another device, instead of acquiring the image data in the sRGB format.

In the above-described embodiment, the exemplified printing system 100 can perform overprinting of the white ink. However, the present disclosure can be applied without being limited to the case in which overprinting of the white ink is performed. For example, the present disclosure can also be applied to a case in which an ink for which overprinting is desirable to obtain good color development as in the case of the white ink. For example, the present disclosure can be applied to a case in which the background is completely painted in silver color without gaps.

A plurality of the white ink heads 35W that eject the same white ink can be mounted on the printer 30 of the above-described embodiment. The present disclosure can also be applied to a case in which a plurality of the ink heads 35 that eject different inks of similar colors are mountable on the printer 30. For example, a plurality of the white ink heads 35W for which ink color tones are slightly different from each other may be mounted on the printer 30. In this case, the user can specify a desired one or more of the white ink heads 35W in accordance with the color tone of the white ink. Further, the white ink may be ejected simultaneously from a plurality of the white ink heads 35W. The number of the nozzles 36 provided on each of the ink heads 35 is not limited to 128.

In the above-described embodiment, there are three conditions specified for the printing conditions, namely, the number of heads used, the resolution, and the maximum density. However, the printing conditions that can be specified can be changed. For example, the resolution may not be specified. Another condition may be specified as a printing condition. More specifically, the PC 1 may allow the user to specify a condition (for example, brightness of an image) other than the above-described three printing conditions.

In the above-described embodiment, the maximum density may be specified by the user as shown by the processing at step S29 in FIG. 10, for example. Therefore, the user can cause white color printing to be performed at a desired density. However, the maximum density need not necessarily be specified by the user. For example, the PC 1 may store in advance the maximum density that is suitable for the color, the material and the like of the print medium, and may automatically set the maximum density that is suitable for the print medium on which printing is to be performed. When image data is generated, data of the maximum density may be added to the image data. The maximum density may be a fixed value and only the unit density may be changed. In a case where the maximum density is specified by the user, the method for accepting an input to specify the maximum density can be changed as appropriate. For example, the PC 1 may accept a value for the maximum density that is input directly by the user using the keyboard 3 and the like. The PC 1 may set the maximum density in accordance with information indicating the color and the like of the print medium input by the user. This also applies to the input of the resolution.

The number of heads used need not necessarily be specified directly by the user. For example, the PC 1 may set, as the number of heads used, the number of mounted heads corresponding to a model name that is specified by the user from among model names of the plurality of printers 30 having a different number of mounted heads.

In a case where the candidate value of the number of heads used is 0, the PC 1 of the above-described embodiment grays out the display of the maximum density on the printing condition input screen 63 (refer to FIG. 13). In this manner, the PC 1 inhibits the maximum density from being displayed in a state in which it can be specified (refer to step S22 in FIG. 10). When the range of the maximum density that can be specified is changed, the graying-out technique is also used (refer to FIG. 12). However, the method for limiting the display state in which the maximum density can be specified is not limited to the graying-out technique. For example, it is possible for the PC 1 not to display the candidates of the maximum density. It may be desirable for a user's convenience that the printing condition input screens 61 to 63 are changed in accordance with the candidate value for the number of heads used, as in the above-described embodiment. However, a common printing condition input screen may be used regardless of the number of heads used.

In the above-described embodiment, the minimum number of scans that are required to perform printing at the maximum density M is determined as the necessary scanning number of times n at step S7 in FIG. 9. Thus, the PC 1 can inhibit the printing time from being increased more than is necessary. However, the number scans that is equal to or more than the minimum number of scans may be determined as the necessary scanning number of times n.

In the above-described embodiment, the white head to be used is randomly selected for each scan at step S74 in FIG. 16. As a result, there is a less possibility that the nozzles 36 of a particular one of the white ink heads 35W will dry up. However, the method for selecting the white head to be used may be changed. For example, the white head to be used may be changed every time a predetermined number of scans (for example, five scans) are performed, instead of being changed every time one scan is performed. The PC 1 may change the white head to be used every time the PC 1 generates print data. The PC 1 may set the white head to be used in accordance with a predetermined order, instead of randomly selecting the white head to be used.

The PC 1 of the above-described embodiment sets the number of passes of multi-pass printing in the final set (the final printing unit), among a plurality of sets of multi-pass printing, to be largest, in the first generation processing shown in FIG. 17. As a result, the topmost surface of the white printing surface is formed by multi-pass printing with a large number of passes. Thus, the printing quality can further be improved. Further, the PC 1 generates the print data that causes the printer 30 to perform multi-pass printing as many times as possible such that the number of passes is increased as much as possible. As a result, it is possible to further improve the printing quality. However, if multi-pass printing is performed only in the final printing unit, the printing quality (particularly, the color printing quality) can be improved as compared to a case in which printing with the single method is performed in the last scan. Therefore, for example, the number of passes of each of a plurality of sets of multi-pass printing may be the same number. Specific processing contents of the first generation processing shown in FIG. 17 may be changed. For example, after performing the processing (refer to step S85 to step S87) that generates the print data that causes multi-pass printing to be performed in the final printing unit, the PC 1 may perform the processing (step S96) that generates the print data that causes printing with the single method to be performed in all the remaining scans. In this case, the processing from step S89 to step S94 may be omitted. Even in a case where multi-pass printing is not performed in the final printing unit, multi-pass printing may be included in a printing operation. In this case, the printing quality can be improved as compared to a case in which multi-pass printing is not included.

The printer 30 of the above-described embodiment is configured such that the white ink heads 35W and the color ink heads 35C, 35M, 35Y and 35K can be mounted on the single carriage 34. Therefore, the printer 30 can perform simultaneous printing of white and color. In the first generation processing (refer to FIG. 17), the PC 1 generates the print data that causes the printer 30 to perform multi-pass printing in the final printing unit. With this print data, it is possible to cause the printer 30 to perform simultaneous printing of white and color with high quality, without increasing the number of scans. However, the present disclosure can also be applied to a case in which a printer that does not perform simultaneous printing of white and color is used. More specifically, with the processing that generates the common data (refer to step S9 and step S10 in FIG. 9), the PC 1 can easily and appropriately generate the print data to perform overprinting, regardless of whether or not the printer 30 is caused to perform simultaneous printing. In a similar manner, with the printing condition setting processing (refer to FIG. 10), the user can change the number of heads used, taking printing quality and printing time into consideration, regardless of whether or not the printer 30 is caused to perform simultaneous printing. The processing that generates the common data and the printing condition setting processing can also be applied to the generation of print data that causes a printer that prints with only one color (for example, white) to perform printing. It is also possible that, of the processing explained in the above-described embodiment, only the processing that generates the common data is applied, and the processing that generates the print data from the common data is simplified (for example, the processing at step S63 in FIG. 15 only is adopted).

In the above-described embodiment, single CPU may perform all of the processing. Nevertheless, the disclosure may not be limited to the specific embodiment thereof, and a plurality of CPUs, a special application specific integrated circuit ("ASIC"), or a combination of a CPU and an ASIC may be used to perform the processing.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An apparatus comprising:

a control portion; and a non-transitory memory configured to store computer-readable instructions that, when executed by the control portion, cause the apparatus to perform the steps of:

determining a scanning number of times being a number of times that a printer carriage mounting a plurality of ink heads thereon is to be moved in a main scanning direction to form a single line image formed by a single dot array extending in the main scanning direction and having a width, in a sub scanning direction orthogonal to the main scanning direction, corresponding to a size of a nozzle formed in the ink head and to increase a maximum density of a first ink in the single line image to be higher than a unit density by ejecting the first ink a plurality of times to the single dot array, the printer carriage being provided in a printer, the plurality of ink heads having at least one first ink head configured to eject the first ink and at least one second ink head configured to eject a second ink, the one first ink head and the one second ink head being aligned along the sub scanning direction, the unit density being a density of a maximum amount of ink that can be ejected by moving the carriage once with respect to a single dot array; and generating, in a case where the scanning number of times is larger than a minimum value of a number of passes that can be set as a number of times of scans of a set of multi-pass scans, print data to cause ejection of the first ink and ejection of a second ink to be performed by the multi-pass scans in a final printing unit, among a plurality of scans to be performed a plurality of times equal to the scanning number of times, the set of multi-pass scans being a set of a plurality of scans in which, every time a scan is performed, an ink is ejected to the single dot array from a nozzle different from a nozzle used in a preceding scan, among a plurality of nozzles provided on each of the plurality of ink heads, the final printing unit being continuous scans corresponding to the number of passes including a last scan, among the scans to be performed the scanning number of times, and the second ink being an ink whose density is equal to or less than the unit density.

2. The apparatus according to claim 1, wherein in a case where a plurality of sets of the multi-pass scans are included in the scans to be performed the scanning number of times, the generating of the print data includes setting the number of passes for each of the plurality of sets, and generating the print data such that the number of passes for the multi-pass scans to be performed in the final printing unit is the largest.

3. The apparatus according to claim 2, wherein the generating of the print data includes generating the print data that includes an increased number of the multi-pass scans with an increased number of passes.

4. The apparatus according to claim 3, wherein the first ink is a white ink.

5. The apparatus according to claim 4, wherein the plurality of ink heads mounted on the carriage include:

a plurality of first ink heads configured to eject the first ink, the plurality of first ink heads being arranged side by side in the main scanning direction; and a plurality of second ink heads configured to eject the second ink, the plurality of second ink heads being arranged side by side in the main scanning direction and in positions displaced from the plurality of first ink heads in a sub-scanning direction.

6. The apparatus according to claim 2, wherein the first ink is a white ink.

7. The apparatus according to claim 1, wherein the generating of the print data includes generating the print data that includes an increased number of the multi-pass scans with an increased number of passes.

8. The apparatus according to claim 7, wherein the first ink is a white ink.

9. The apparatus according to claim 1, wherein the first ink is a white ink.

10. The apparatus according to claim 1, wherein the plurality of ink heads mounted on the carriage include:

a plurality of first ink heads configured to eject the first ink, the plurality of first ink heads being arranged side by side in the main scanning direction; and a plurality of second ink heads configured to eject the second ink, the plurality of second ink heads being arranged side by side in the main scanning direction and in positions displaced from the plurality of first ink heads in a sub-scanning direction.

11. A non-transitory computer-readable medium storing computer-readable instructions, the instructions, when executed by a processor of a computer, performing processes comprising:

a determination operation determining a scanning number of times being a number of times that a printer carriage mounting a plurality of ink heads thereon is to be moved in a main scanning direction to form a single line image formed by a single dot array extending in the main scanning direction and having a width, in a sub scanning direction orthogonal to the main scanning direction, corresponding to a size of a nozzle formed in the ink head and to increase a maximum density of a first ink in the single line image to be higher than a unit density by ejecting the first ink a plurality of times to the single dot array, the printer carriage being provided in a printer the plurality of ink heads having at least one first ink head configured to eject the first ink, and at least one second ink head configured to eject a second ink, the one first ink head and the one second ink head being aligned along the sub scanning direction, the unit density being a density of a maximum amount of ink that can be ejected by moving the carriage once with respect to a single dot array; and a generation operation generating, in a case where the scanning number of times is larger than a minimum value of a number of passes that can be set as a number of times of scans of a set of multi-pass scans, print data to cause ejection of the first ink and ejection of a second ink to be performed by the multi-pass scans in a final printing unit, among a plurality of scans to be performed a plurality of times equal to the scanning number of times, the set of multi-pass scans being a set of a plurality of scans in which, every time a scan is performed, an ink is ejected to the single dot array from a nozzle different from a nozzle used in a preceding scan, among a plurality of nozzles provided on each of the plurality of ink heads, the final printing unit being continuous scans corresponding to the number of passes including a last scan, among the scans to be performed the scanning number of times, and the second ink being an ink whose density is equal to or less than the unit density.

12. The non-transitory computer-readable medium according to claim 11, wherein in a case where a plurality of sets of the multi-pass scans are included in the scans to be performed the scanning number of times, the generation operation includes setting the number of passes for each of the plurality of sets, and generating the print data such that the number of passes for the multi-pass scans to be performed in the final printing unit is the largest.

13. The non-transitory computer-readable medium according to claim 12, wherein the generating of the print data includes generating the print data that includes an increased number of the multi-pass scans with an increased number of passes.

14. The non-transitory computer-readable medium according to claim 13, wherein the first ink is a white ink.

15. The non-transitory computer-readable medium according to claim 14, wherein the plurality of ink heads mounted on the carriage include:

a plurality of first ink heads configured to eject the first ink, the plurality of first ink heads being arranged side by side in the main scanning direction; and a plurality of second ink heads configured to eject the second ink, the plurality of second ink heads being arranged side by side in the main scanning direction and in positions displaced from the plurality of first ink heads in a sub-scanning direction.

16. The non-transitory computer-readable medium s according to claim 12, wherein the first ink is a white ink.

17. The non-transitory computer-readable medium according to claim 11, wherein the generation operation includes generating the print data that includes an increased number of the multi-pass scans with an increased number of passes.

18. The non-transitory computer-readable medium according to claim 17, wherein the first ink is a white ink.

19. The non-transitory computer-readable medium according to claim 11, wherein the first ink is a white ink.

20. The non-transitory computer-readable medium according to claim 11, wherein the plurality of ink heads mounted on the carriage include:

a plurality of first ink heads configured to eject the first ink, the plurality of first ink heads being arranged side by side in the main scanning direction; and a plurality of second ink heads configured to eject the second ink, the plurality of second ink heads being arranged side by side in the main scanning direction and in positions displaced from the plurality of first ink heads in a sub-scanning direction.

* * * * *